US012215515B2

(12) United States Patent
Wang

(10) Patent No.: US 12,215,515 B2
(45) Date of Patent: Feb. 4, 2025

(54) MULTI-PURPOSE SHELTER

(71) Applicant: ALION HOME INC., La Puente, CA (US)

(72) Inventor: Guangtian Wang, Hacienda Heights, CA (US)

( * ) Notice: Subject to any disclaimer, the term of this patent is extended or adjusted under 35 U.S.C. 154(b) by 194 days.

(21) Appl. No.: 18/062,564

(22) Filed: Dec. 6, 2022

(65) Prior Publication Data

US 2023/0096848 A1 Mar. 30, 2023

Related U.S. Application Data

(63) Continuation-in-part of application No. 17/223,902, filed on Apr. 6, 2021, now abandoned.

(51) Int. Cl.

| | |
|---|---|
| ***E04H 15/40*** | (2006.01) |
| ***E04H 15/54*** | (2006.01) |
| ***E04H 15/60*** | (2006.01) |
| *E04H 15/32* | (2006.01) |

(52) U.S. Cl.

CPC ..... *E04H 15/405* (2013.01); *E04H 15/54* (2013.01); *E04H 15/60* (2013.01); *E04H 2015/326* (2013.01)

(58) Field of Classification Search

CPC ..... E04H 15/40; E04H 15/58; E04H 15/36; E04H 15/62; E04H 15/405

See application file for complete search history.

(56) References Cited

U.S. PATENT DOCUMENTS 3,394,720 A * 7/1968 Moss ..... E04H 15/003 D21/837
3,404,696 A * 10/1968 De Souza Filho ... E04H 15/003 135/904
4,311,159 A * 1/1982 Wunderlich ..... E04H 15/40 135/100
5,299,590 A * 4/1994 Deibert ..... E04H 15/58 135/125
5,924,132 A * 7/1999 Wigutow ..... A45F 4/14 2/69.5
5,927,311 A * 7/1999 Jager ..... E04H 15/003 135/124
7,673,642 B1 * 3/2010 Shires ..... E04H 15/36 135/136

(Continued)

FOREIGN PATENT DOCUMENTS

GB 2148967 A * 6/1985 ..... E04H 15/40

*Primary Examiner* — Noah Chandler Hawk
(74) *Attorney, Agent, or Firm* — Tsz Lung Yeung

(57) ABSTRACT

A multi-purpose shelter includes a covering fabric, a first rod member, a plurality of loop straps, a plurality of cords and at least a weight member. The covering fabric has a plurality of side edges, and a first pocket extending along a transverse direction thereof. The first rod member has a forward end, a backward end, and a main portion extending between the forward end and the backward end. The main portion passes through the first pocket of the covering fabric, and is folded to form a curved contour between the forward end and the backward end to be erected on a support surface. Each cord connects the covering fabric to a support surface in a stretched manner. The weight member is detachably attached on one of the forward end and the backward end of the first rod member for providing a secure support to the multi-purpose shelter.

7 Claims, 21 Drawing Sheets

(56) References Cited

U.S. PATENT DOCUMENTS

| | | | | |
|---|---|---|---|---|
| 7,708,339 | B2 * | 5/2010 | Zapater | A47C 1/14 135/96 |
| 7,841,356 | B2 * | 11/2010 | Shires | E04H 15/42 135/156 |
| 8,789,549 | B1 * | 7/2014 | Barnes | E04H 12/2246 135/114 |
| 9,593,507 | B1 * | 3/2017 | Aicher, Jr. | E04H 15/40 |
| 10,066,417 | B1 * | 9/2018 | Linyard | E04H 1/1205 |
| 2008/0210282 | A1 * | 9/2008 | Turcot | E04H 15/06 135/88.14 |

* cited by examiner

MULTI-PURPOSE SHELTER

CROSS REFERENCES OF RELATED APPLICATION

This application is a Continuation-In-Part of a non-provisional application having an application number of Ser. No. 17/223,902, and a filing date of Apr. 6, 2021, the entire specification of which is herein incorporated by reference.

BACKGROUND OF THE PRESENT INVENTION

Field of Invention

The present disclosure relates to a shelter, and more particularly to a multi-purpose shelter having a covering fabric being conveniently expanded and suspendedly supported above an support surface by at least a first rod member and a plurality of cords.

Description of Related Arts

Generally, the use of shelter of known designs and configuration is known in the prior art and includes various forms of support structures for supporting the materials of the covering in the desired configuration. The shelter generally comprises a plurality of elongate longitudinal support rods, a plurality of one elongated transverse support rod, and a plurality of sleeves longitudinally and transversely arranged on the covering. In this respect, the longitudinal support rods and the transverse support rods may be received within the longitudinally arranged sleeves and the transversely-arranged sleeves of the covering respectively and the covering is expanded and suspended above a shaded surface.

To overcome this known problem, past solutions has involved using a single longitudinal or transverse support rod and a single cord coupled with the covering of the shelter to minimize the total weight of the shelter and facilitate the user for assembling or disassembling. However, it may cause the overall configuration of the shelter without having a reliable supporting structure.

Although present shelters are functional, they are not sufficiently efficient or otherwise satisfactory. Accordingly, a shelter which is simple to fabricate, assemble and package, is needed to develop and such a novel shelter is disclosed and claimed herein.

SUMMARY OF THE PRESENT INVENTION

Certain variations of the present invention provide a multi-purpose shelter having a covering fabric being conveniently expanded and suspendedly supported above an support surface by at least a first rod member and a plurality of cords.

Certain variations of the present invention provide a multi-purpose shelter in which the covering fabric is capable of being supported by several rod members to form a wide variety of erection patterns. Each of these erection patterns may be conveniently assembled and disassembled in outdoor environment.

In one aspect of the present invention, it provides a multi-purpose shelter, comprising;

a covering fabric having a plurality of side edges, and a first pocket extending along a transverse direction of said covering fabric;

a first rod member having a first forward end, a first backward end, and a first main portion extending between said first forward end and said first backward end, said first main portion passing through said first pocket of said covering fabric, and being folded to form a curved contour between said first forward end and said first backward end so as to be erected on a support surface;

a plurality of cords each having a first end portion detachably connected to one of said side edges of said covering fabric, and a second end portion affixed on said support surface at a predetermined angle, each of said cords being stretched to establish a predetermined amount of tension for pulling said covering fabric; and at least a weight member detachably attached on one of said first forward end and said first backward end of said first rod member for providing a secure support to said multi-purpose shelter on said support surface, said covering fabric being supported by said first rod member and said and stretched by said cords to form a shelter space underneath said covering fabric.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

As used herein, the term "support end" in conjunction with an object has a portion able to couple with the cord. For example, the object could be a ground, a vehicle, a building, a streetlamp, trees, house eaves, or beams. It should be noted that the object could comprise the support end which allow the cord being coupled thereon in order to support a multi-purpose shelter for covering a surface/ground.

Figure 1:
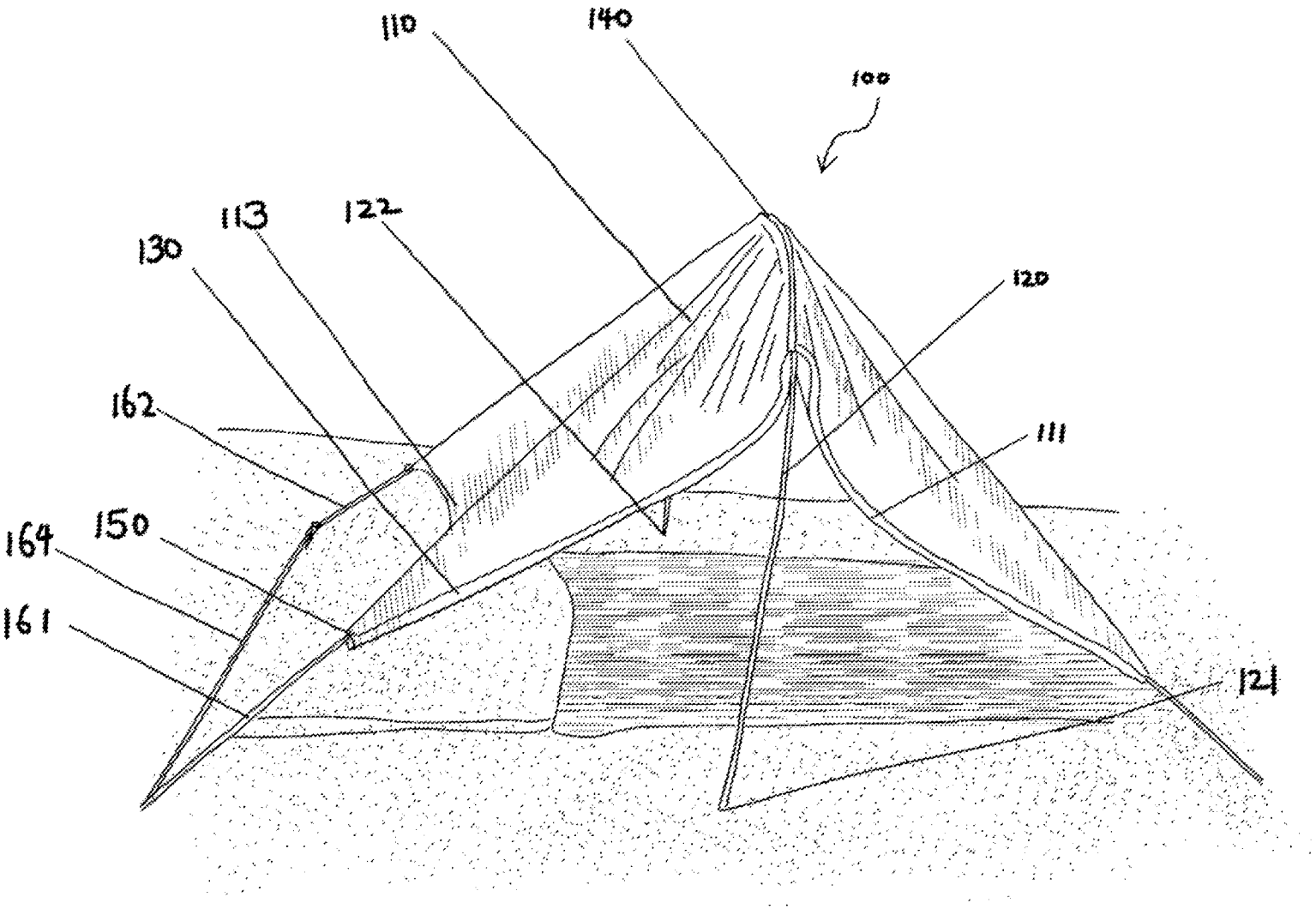
FIG. 1 is a front view of an embodiment of a multi-purpose shelter for covering a surface according to an aspect of a first preferred embodiment.
Figure 2:
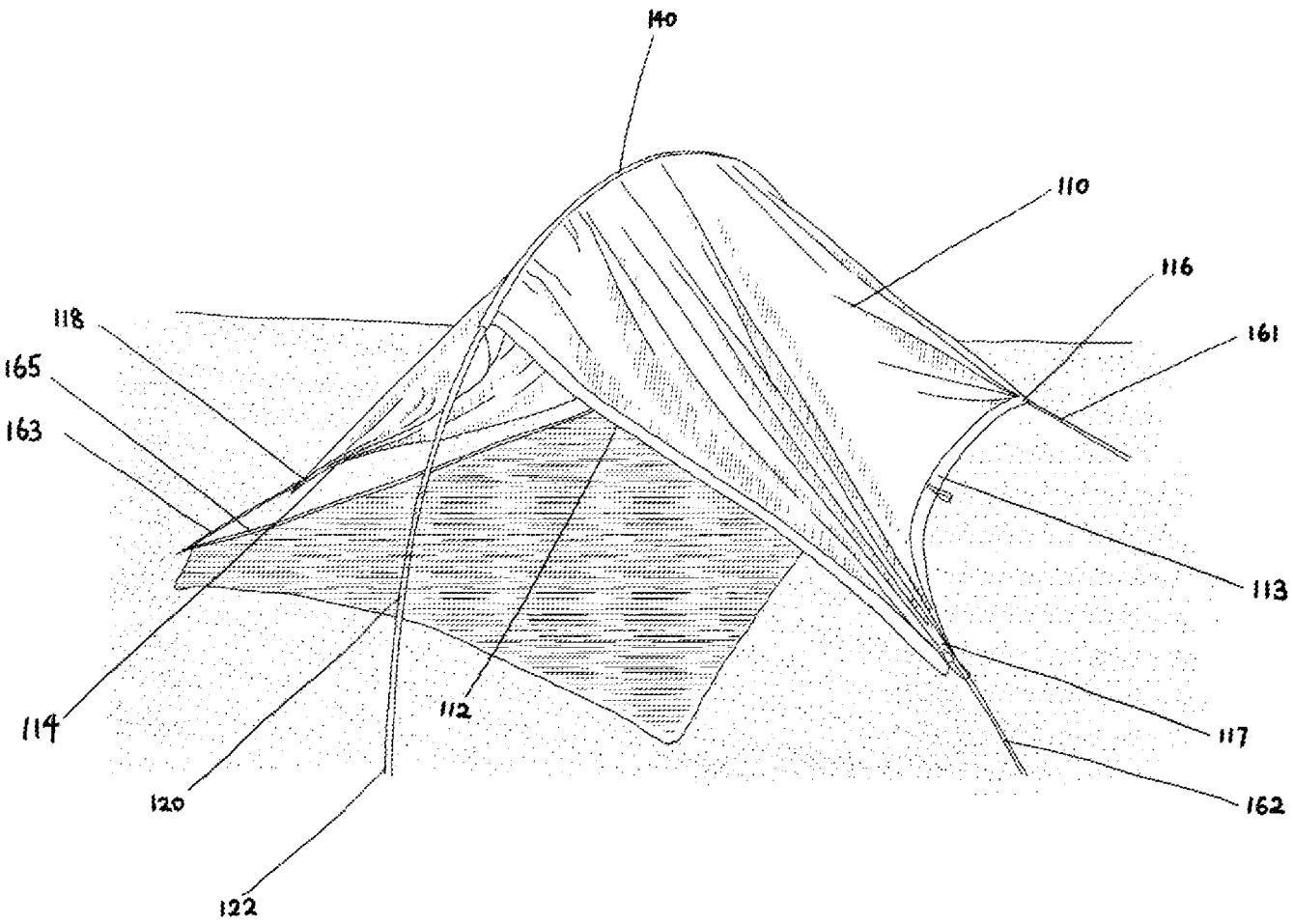
FIG. 2 is a rear view of an embodiment of the multi-purpose shelter for covering a surface according to an aspect of the first preferred embodiment.

FIGS. 1 and 2 generally depict the basic architecture of a multi-purpose shelter 100 for covering a surface in accordance with the one of the disclosed first preferred embodiment.

The multi-purpose shelter 100 comprises a first rod member 120 having a forward end 121 and a backward end 122, a covering 110 having a plurality of corners and a plurality of side edges, a plurality of side pockets 130 arranged along the side edges of the covering 110, a middle pocket 140 transversely formed across the covering 110, a plurality of loop straps 150 spacedly formed on the side edges or each of the side edges of the covering 110 and formed at the corners, and a plurality of cords coupled on the loop straps 150 formed on the plurality of corners or each of the plurality of corners to expand the covering and secure the covering on the surface, wherein one of the loop straps 150 may be formed at one of the corners of the covering 110 respectively.

The side edges comprise a front side edge 111, a rear side edge 112 parallel with the front side edges 111, a left side edge 113 vertically arranged with the front side edge 111 and a right side edge 114, and the right side edge 114 vertically arranged with the front side edge 111 and the rear side edge 112, wherein each of the corners may be formed at the two vertically-arranged side edges.

Turning now to FIG. 1, each of cords comprises a first end coupled with the loop strap formed on one of the corners and a second end being secured on the surface, wherein the multi-purpose shelter 100 further comprises a plurality of pegs, wherein each of the pegs is coupled with the second end of each one of the cords to secure each one of the cords at an angle respect to the surface.

With specific reference to FIGS. 1-2, the middle pocket 140 may bisect the covering 110 into two equal area sections. The first rod member 120 may be loosely received within the middle pocket 140, wherein the forward end 121 and the backward end 122 may be concavely extended at an acute angle with the surface. In this first embodiment, each of the angles formed by the cords respect to the surface may be equal or different, and the acute angles formed by each of the forward end 121 and the backward end 122 of the first rod member 120 with the surface may be equal or different. Preferably, the angles formed by each of the cords are equal and each of the acute angels formed by each of the forward end 121 and the backward end 122 are equal. Preferably, each of the angles formed by each of the cords is smaller than each of the acute angles formed by each of the forward end 121 and the backward end 122 of the first rod member 120.

The first rod member 120 may be sufficiently flexible to permit the forward end 121 and the backward end 122 to be bent down and secured on the surface, wherein the first rod member 120 comprises a plurality of elongated rod segments in a collapsed or foldable condition. Each of the elongated rod segments may be a hollow tube having a supporting portion and an engaging portion formed at one end of the supporting portion, wherein a diameter of the engaging portion is smaller than a diameter of the supporting portion, wherein the engaging portion is telescopically received within the supporting portion to form the first rod member 120. In this way, an elastic cord extends continuously through the elongated rod segments and is secured to each end of the elongated rod segments.

It should be noted that the elongated rod segments may be made of a material selected from a group consisting of PVC, CPVC, PEX, copper, iron, polyethylene, ABS, and galvanized steel. The contemplated elongated rod segments can be made of suitable materials to withstand temperature extreme and the chemical environment, such materials include natural and synthetic polymers, various metals and metal alloys, and all reasonable combinations thereof.

The covering 110 may be a square or rectangular covering, wherein each of the side edges of the covering 110 is vertically arranged with each other to form a corner, wherein the covering 110 comprises a first corner, a second corned, a third corner, and a fourth corner.

Figure 4:
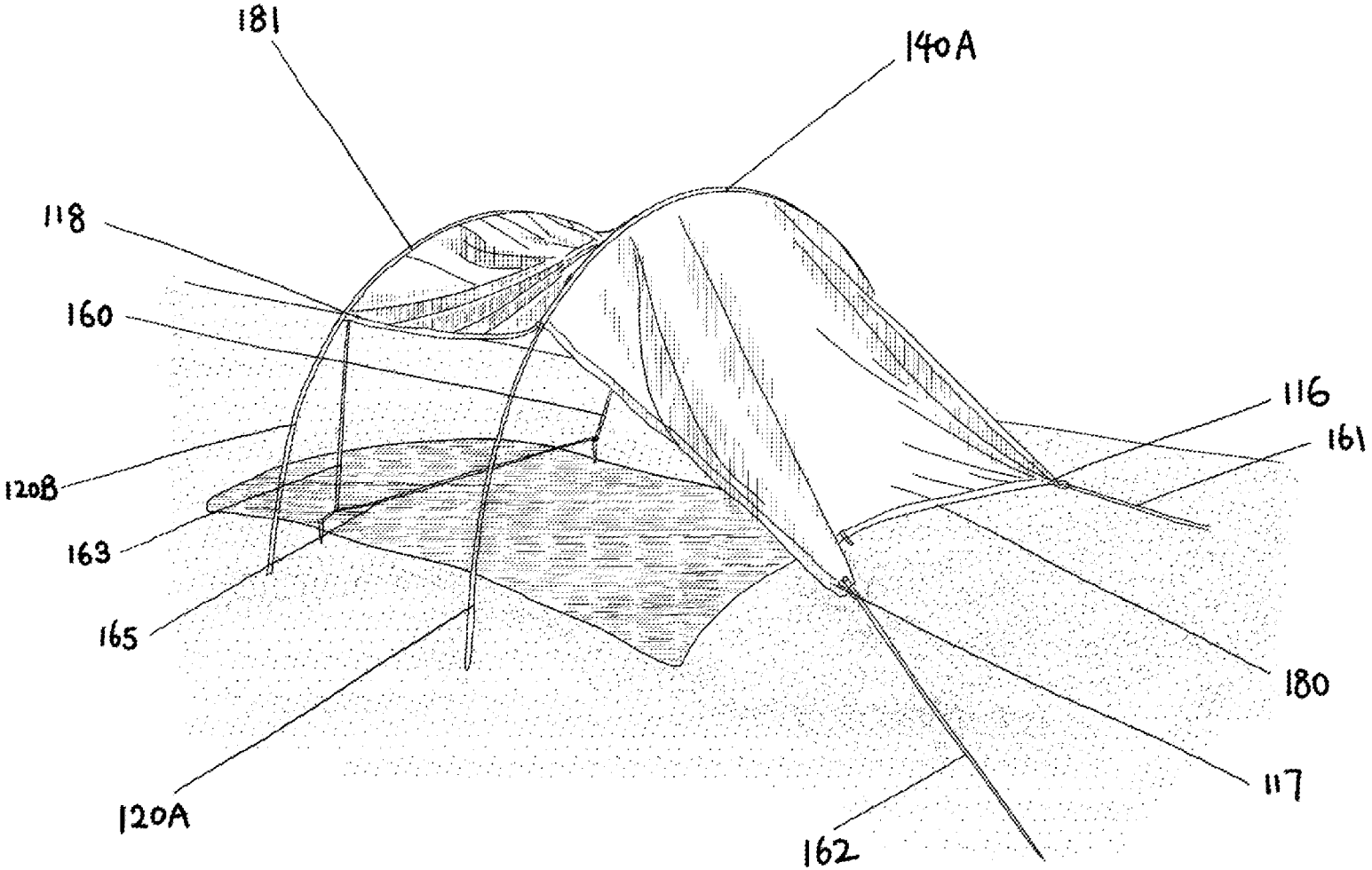
FIG. 4 is a perspective view of the first alternative mode of the multi-purpose shelter for covering a surface according to an aspect of the first preferred embodiment.

A further feature of the first preferred embodiment shown in FIGS. 1, 2, and 4, during the uses of the multi-purpose shelter, the plurality of cords comprises a first cord 160 having the first end coupled with the loop strap formed on the first corner and the second end of the first cord secured on the surface at an angle respect to the surface, a second cord 161 having the first end coupled with the loop strap formed on the second corner and the second end of the second cord secured the surface at an angle respect to the surface, a third cord 162 having the first end coupled with the loop strap formed on the third corner and the second end of the third cord secured on the surface at an angle respect to the surface, and a fourth cord 163 having the first end coupled with the loop strap formed on the fourth corner and the second end of the fourth cord secured on the surface at an angle respect to the surface. In this manner, the covering 110 may be expanded by pulling the corners where the cords are coupled thereon in order to expend and suspend the covering above the shaded surface.

A further feature of the first embodiment shown in FIGS. 1 and 2 is that the surface covered by the covering 110 may be adjusted by the acute angle formed by first rod member 120 with the surface and the angles formed by the cords respect to the surface. In this case, a larger acute angle, preferably larger than 45 degrees, formed by each of the forward end 121 and the backward end 122 of the first rod member 120 with the surface and larger angles, preferably larger 45 degrees, formed by the cords respect to the surface may generate a smaller shaded area. In the other words, a smaller acute, preferably less than 45 degrees, formed by each of the forward end 121 and the backward end 122 of the first rod member 120 with the surface and smaller angles, preferably less than 45 degrees, formed by the cords respect to the surface may generate a larger shaded area.

Referencing to FIGS. 1 and 2, the multi-purpose shelter 100 further comprises at least one supporting cord having a first supporting cord 164 being longitudinally coupled on each of the second ends of the second cord 161 and the third cord 162 and a second supporting cord 165 being longitudinally coupled on each of the second ends of the first cord 160 and the fourth cord 163. These first and second supporting cords 164, 165 may be employed to maintain the stability of the multi-purpose shelter 100 while the multi-purpose shelter is to be used on a windy beach.

From the above description, the first rod member 120, the cords, including the first cord 160, the second cord 161, the third cord 162, and the fourth cord 163, and selectively the first and second supporting cord 164, 165 could be employed to support the covering 110 being expanded to create a shaded area without need for any transversely arranged rod member.

In other words, the multi-purpose shelter described in all of the embodiments herein comprises no transversely arranged rod member to support the covering, and the longitudinally arranged first rod member 120 may be employed to bisect the covering 110 and to assist in supporting the covering 110 being located above the surface and the corners of the covering are radially expanded by pulling the cords coupled on the corners of the covering to form the shaded area as see in FIGS. 1 and 2.

Figure 3:
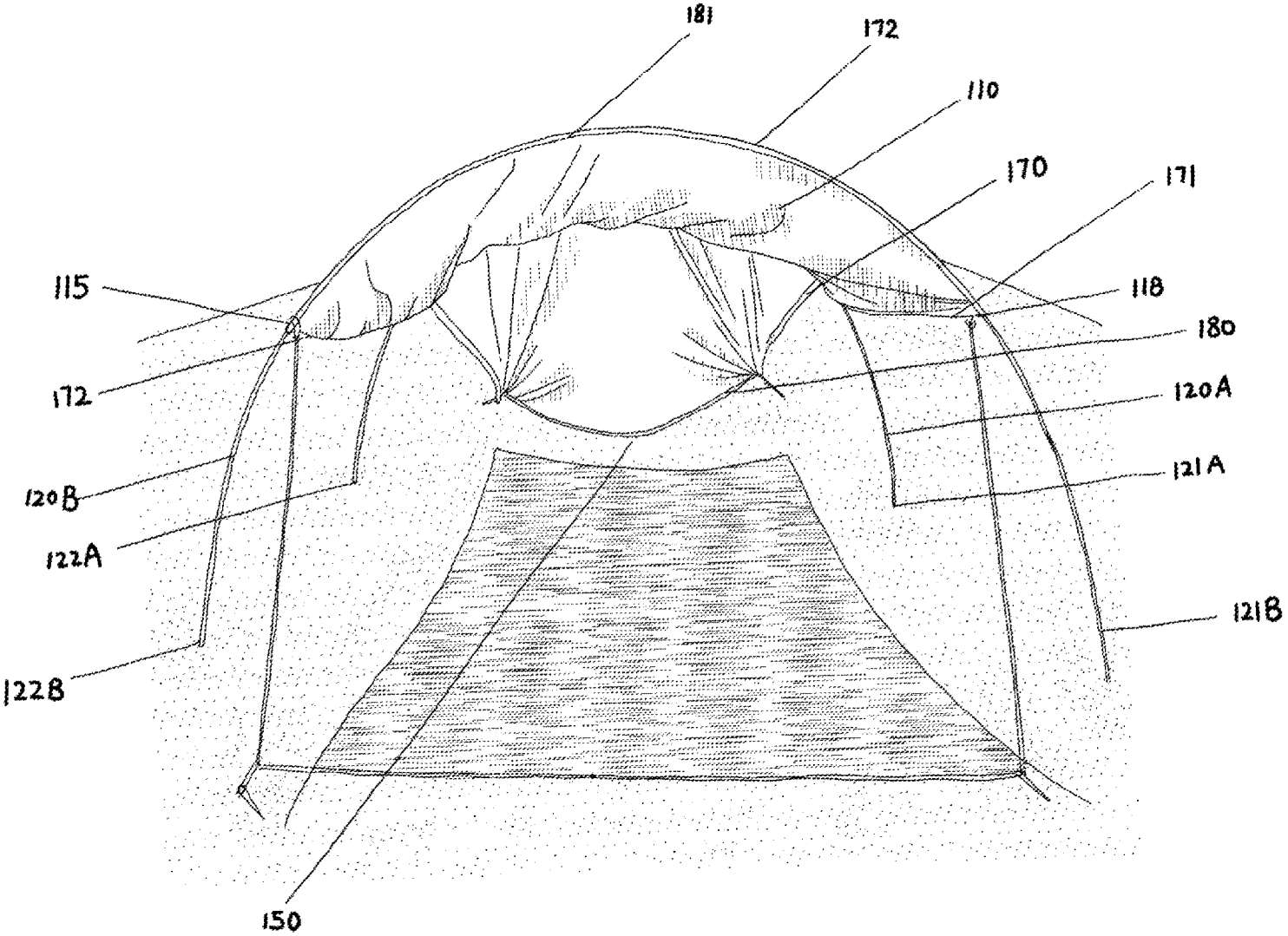
FIG. 3 is a left side view of a first alternative mode of the multi-purpose shelter for covering a surface according to an aspect of the first preferred embodiment.
Figure 5:
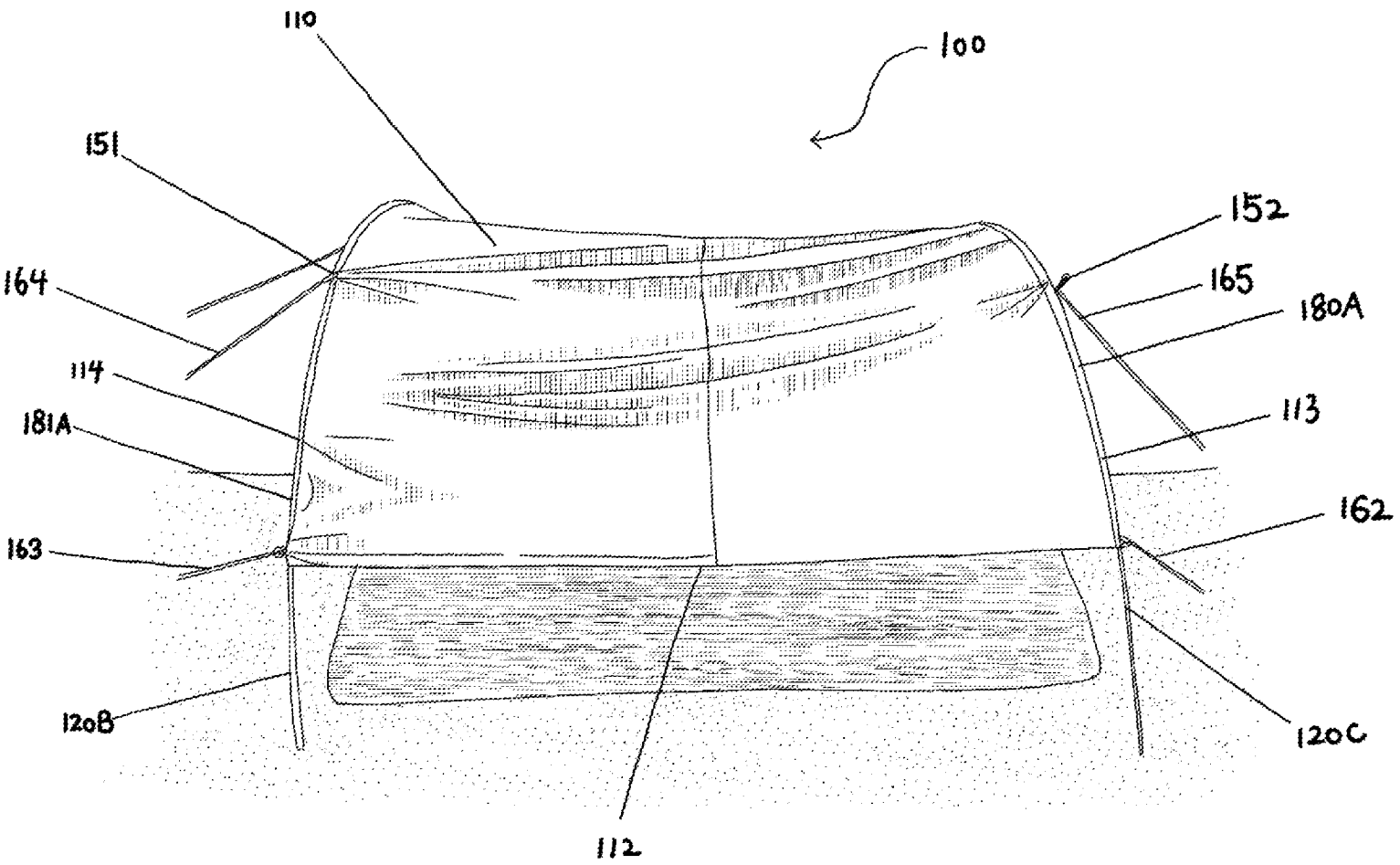
FIG. 5 is a rear view of a second alternative mode of a multi-purpose shelter for covering a surface according to an aspect of the first preferred embodiment.

Turning now to FIGS. 3, 4 and 5, in alternative modes of the first embodiment, the multi-purpose shelter 100 comprises the side pockets arranged along the side edges or each of the side edges of the covering 110, wherein the side edges comprises a left side edge 170 and a right side edge 172 parallel with the left side edge 170, wherein the side pockets comprises a left side pocket 180 arranged along the left side edge 170 and a right side pocket 181 arranged along 15 the right side edge 172.

In another embodiment, the multi-purpose shelter 100 comprises the side pockets, wherein each of the side pockets is arranged at least one of side edges of the covering 110, wherein the side edges comprises a left side edge 170 and a right side edge 172 parallel with the left side edge 170, wherein the side pockets comprises a left side pocket 180 arranged along the left side edge 170 and a right side pocket 181 arranged along the right side edge 172.

FIG. 3 generally depicts a first alternative mode of the multi-purpose shelter 100, wherein the multi-purpose shelter 100 comprises a first rod member 120A longitudinally arranged and loosely received within a middle pocket 140A, wherein the first rod member 120A comprises a forward end 121A and a backward end 122A may be concavely extended at an acute angle with the surface. The multiple-purpose shelter 100 further comprises a second rod member 130B having a forward end 121B and a backward end 122B, wherein the forward end 121B and the backward end 122B of the second rod member 130B are concavely extending at a second acute angle with the surface, wherein the second rod member 130B may be longitudinally arranged and received within the right side pocket 181 or the left side pocket 180.

According to the above first alternative mode of the first embodiment, the covering 110 may be a square or rectangular covering, wherein each of the side edges of the covering 110 is vertically arranged with each other to form a corner, wherein the covering 110 comprises a first corner 115, a second corner 116, a third corner 117, and a fourth corner 118. In this case, as shown in FIGS. 3 and 4, the second corner 116 may be adjacent to the first corner 115, wherein a distance from the first corner 115 to the second corner 116 is longer than a distance from the first corner 115 to the fourth corner 118. Also, the third corner 117 may be an across corner with respect to the first corner 115.

According to the above first alternative mode, the second rod member 130B may be loosely received within the left side pocket 180 or the right side pocket 181. The first rod member 120A may be loosely received within the middle pocket 140A, wherein the forward end 121A and the backward end 121B of the first rod member 120A may be concavely extended at an acute angle with the surface. Also, the first rod member 120A and the second rod member 130B may be made by the same material, have identical dimension, including length, width, height, and diameter, and have the identical structure. In this case, the first rod member 120A may be parallelly-arranged with the second rod member 130B.

The multi-purpose shelter 100 of the above first alternative mode of the first embodiment, as shown in FIGS. 3 and 4, further comprises the plurality of cords having the first cord 160 with the first end coupled with the loop strap formed on the first corner 115 and the second end of the first cord secured on the surface at an angle with respect to the surface, the second cord 161 having the first end coupled with the loop strap formed on the second corner 116 and the second end of the second cord secured the surface at an angle with respect to the surface, the third cord 162 having the first end coupled with the loop strap formed on the third corner 117 and the second end of the third cord 162 secured on the surface, and the fourth cord 163 having the first end coupled with the loop strap formed on the fourth corner 118 and the second end of the fourth cord 163 secured on the surface. However, in this manner, the covering 110 may be expanded by forwardly or transversely pulling the loop strap formed on the second corner 116 by the second cord 161 and forwardly or transversely pulling the loop strap formed on the third corner 117 by the third cord 162.

Referring now to the detail of FIG. 4, the first cord 160 and the fourth cord 163 of the multi-purpose shelter of the above first alternative mode may be employed to support the second rod member 130B being erected on the surface without being employed to expand the covering 110.

A further feature of the first alternative mode of the first embodiment shown in FIGS. 3 and 4 is that the shaded area created by the covering 110 may be adjusted by the acute angle formed by the first rod member 120A with the surface, the acute angle formed by second rod member 130B, and the angles formed by the second cord 161 and third cord 162 respect to the surface. In this case, a larger acute angle, preferably more than 45 degrees, formed by each of the forward end 121A and the backward end 122A of the first rod member 120A with the surface, a larger acute angle, preferably more than 45 degrees, formed by each of the forward end 121A and the backward end 122A of the second rod member 130B with the surface, and larger angles, preferably more than 45 degrees, formed by the cords respect to the surface may generate a smaller shaded area. In the other words, a smaller acute, preferably less than 45 degrees, formed by each of the forward end 121A and the backward end 122A of the first rod member 120A with the surface, a smaller acute, preferably less than 45 degrees, formed by the second rod member 130B with the surface, and smaller angles, preferably less than 45 degrees, formed by the third cord 162 and second cord 161 respect to the surface may generate a larger shaded area. Also, the angles formed by the third cord 162 and second cord 161 with the surface may be smaller than the angles formed by the first cord 160 and fourth cord 163 with the surface.

The angles formed by third cord 162 and second cord 161 respect to the surface may be equal or different, and the acute angle formed by the forward end 121A of the first rod member 120A with the surface is equal to the acute angle formed by the backward end 122A of the first rod member 120A with the surface. Also, the acute angle formed by the forward end 121B of the second rod member 130B with the surface is equal to the acute angle formed by the backward end 122A of the second rod member 130B with the surface, wherein the acute angle formed by the forward end 121B of the second rod member 130B with respect to the surface is equal to the acute angle formed by the forward end 121A of the first rod member 120A with respect to the surface.

Optionally, as shown in FIG. 1 and FIG. 4, the multi-purpose shelter 100 further comprises at least one supporting cord having a first supporting cord 164 being longitudinally coupled on each of the second ends of the second cord 161 and the third cord 162 and a second supporting cord 165 being longitudinally coupled on each of the second ends of the first cord 160 and the fourth cord 163. These first and second supporting cords 164, 165 may be employed to maintain the stability of the multi-purpose shelter while the multi-purpose shelter is to be used on a windy beach.

Figure 6:
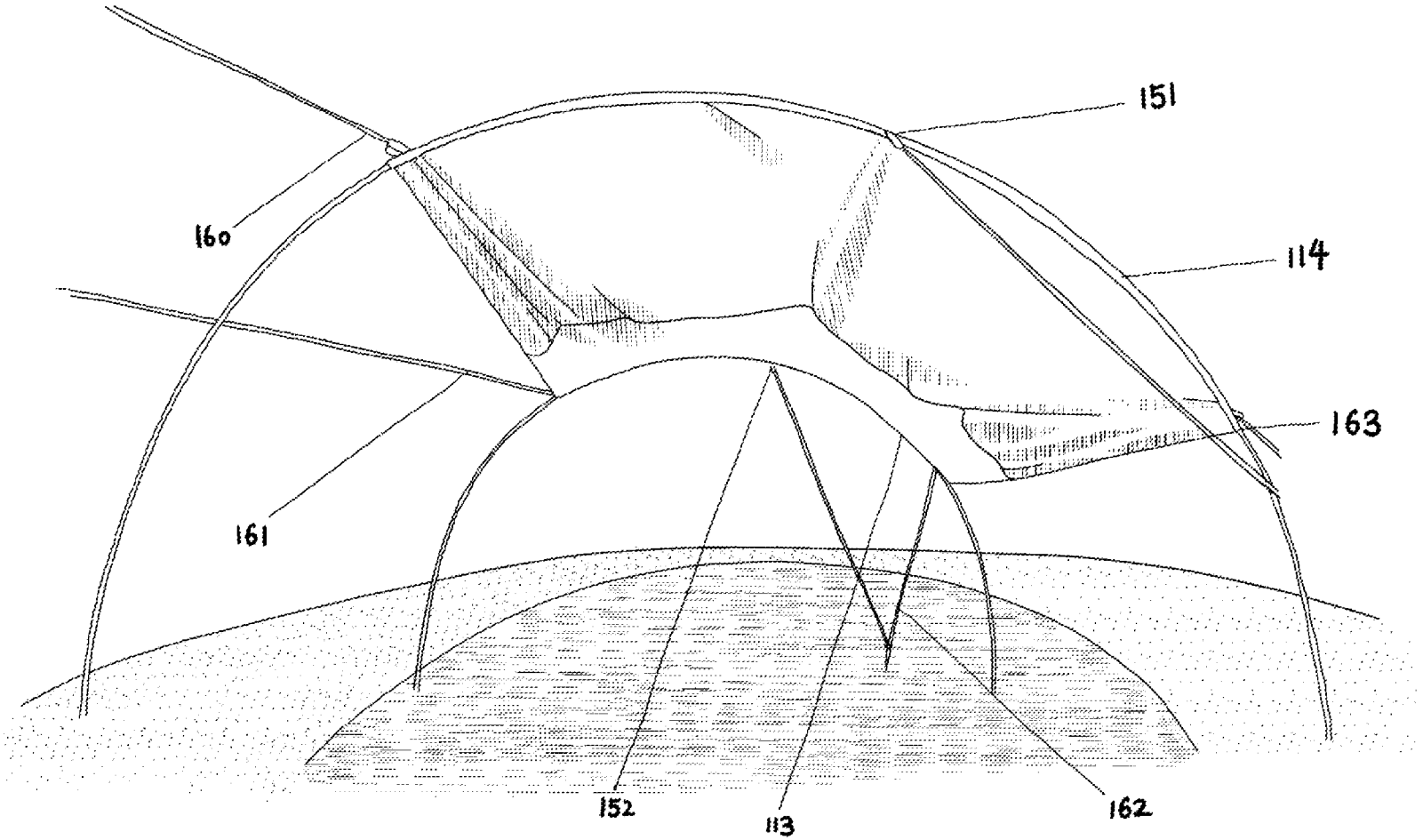
FIG. 6 is a left side view of the multi-purpose shelter of FIG. 5, showing a covering being expanded and suspended above a shaded area by a first and a second rod members.

FIGS. 5 and 6 generally depict second alternative mode of the first embodiment of the multi-purpose shelter 100, wherein the covering 110 of multi-purpose shelter in the second alternative mode is identical to the covering 110 of any of the embodiments and alternatives described herein, and the first rod member 120C and the second rod member 130B described in the second alternative mode are identical to the first and second rod member 130C, 120B of the first alternative mode and the any of the embodiments described herein. Also, the structure of the cords in the second alternative mode is identical to any of the cords in the embodiments described herein excluding the number of cords applied in the second alternative mode and where the cords are coupled thereon.

According to the above second alternative mode, the side pockets comprises a right side pocket 181A formed along the right side edge 114 of the covering 110, and a left side packet 180A parallel with the right side pocket 181A and formed along the left side edge 113 of the covering 110, wherein the first rod member 120C may be loosely received within the left side pocket 180A and the second rod member 130B may be loosely received within the right side pocket 181A. The first rod member 120C comprises a forward end and a backward end and each of the forward end and the backward end is concavely extending at an acute angle with the surface, and the second rod member 130B parallelly-arranged with the first rod member 120C comprises a forward end and a second backward end concavely extending at an acute angle with the surface.

Referring now to the detail of FIG. 5, the multi-purpose shelter further 100 comprises a right middle loop strap 151 formed on the right side edge 114 of the covering 110, a left middle loop strap 152 formed on the left side edge 113 of the covering 110, a front middle loop strap bisects the front side edge of the covering 110 and a rear middle loop strap bisects the rear side edge of the covering 110.

As shown in FIGS. 5 and 6, the multi-purpose shelter 100 further comprises a plurality of cords and each of the cords comprises a first end and a second end, wherein the cords comprises a first cord 160 having the first end coupled with the loop strap formed on the first corner and the second end of the first cord 160 secured on the surface at an angle respect to the surface, a second cord 161 having the first end coupled with the loop strap formed on the second corner and the second end of the second cord 161 secured on the surface at an angle respect to the surface, a third cord 162 having the first end 30 coupled with the loop strap formed on the third corner and the second end of the third cord 162 secured on the surface at an angle respect to the surface, and a fourth cord 163 having the first end coupled with the loop strap formed on the fourth corner and the second end of the fourth cord 163 secured on the surface at an angle respect to the surface.

As shown in FIGS. 5 and 6, the multi-purpose shelter 100 further comprises a fifth cord 166 having the first end coupled with the loop strap arranged on a middle point of a left side edge 114 and the second end secured on the surface at an angle respect to the surface, and a sixth cord 167 having the first end coupled with the loop strap arranged on a middle point of a right side edge 113 and the second end secured on the surface at an angle respect to the surface.

Figure 7:
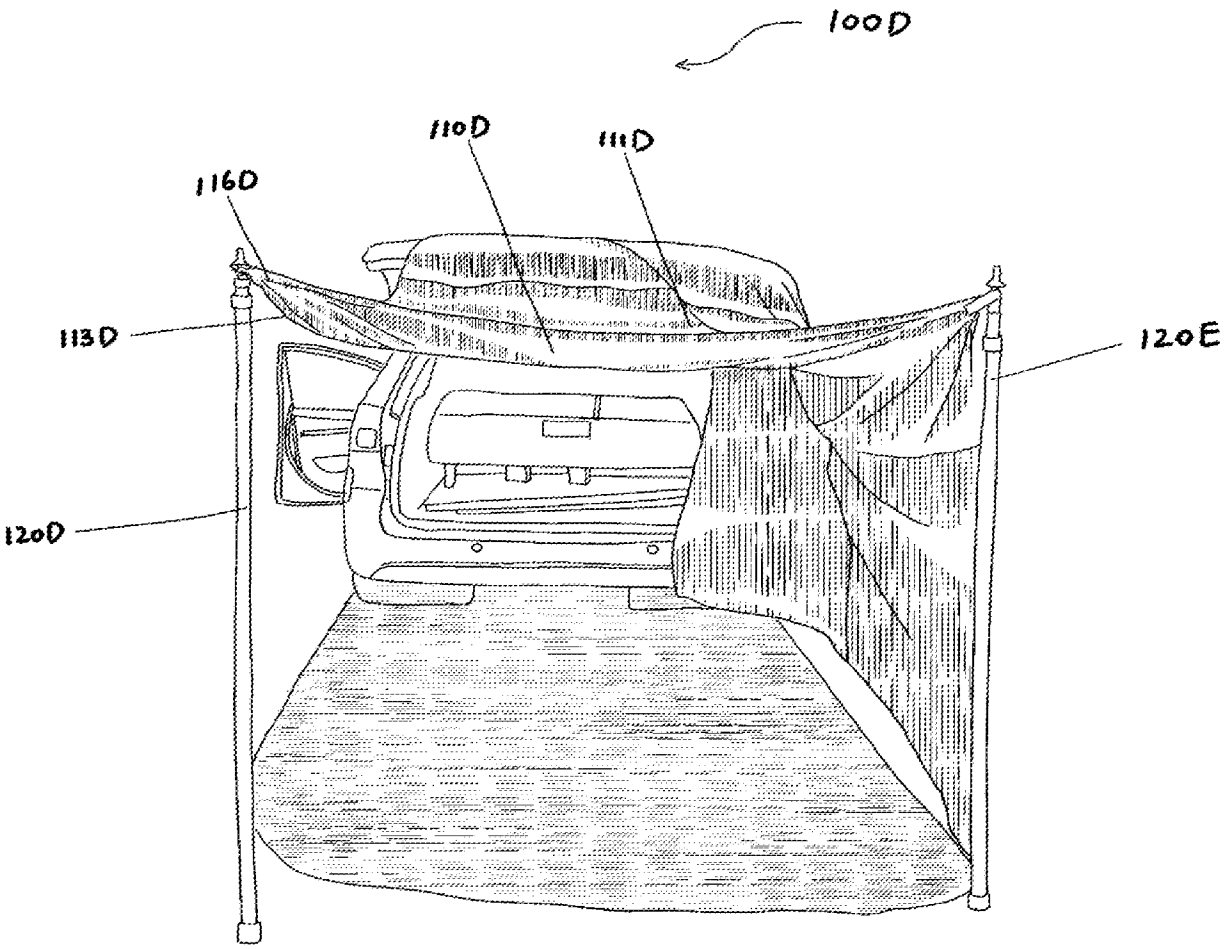
FIG. 7 is a front side view of another one of alternative embodiments of a multipurpose shelter for covering a surface according to an aspect of the first preferred embodiment.
Figure 8:
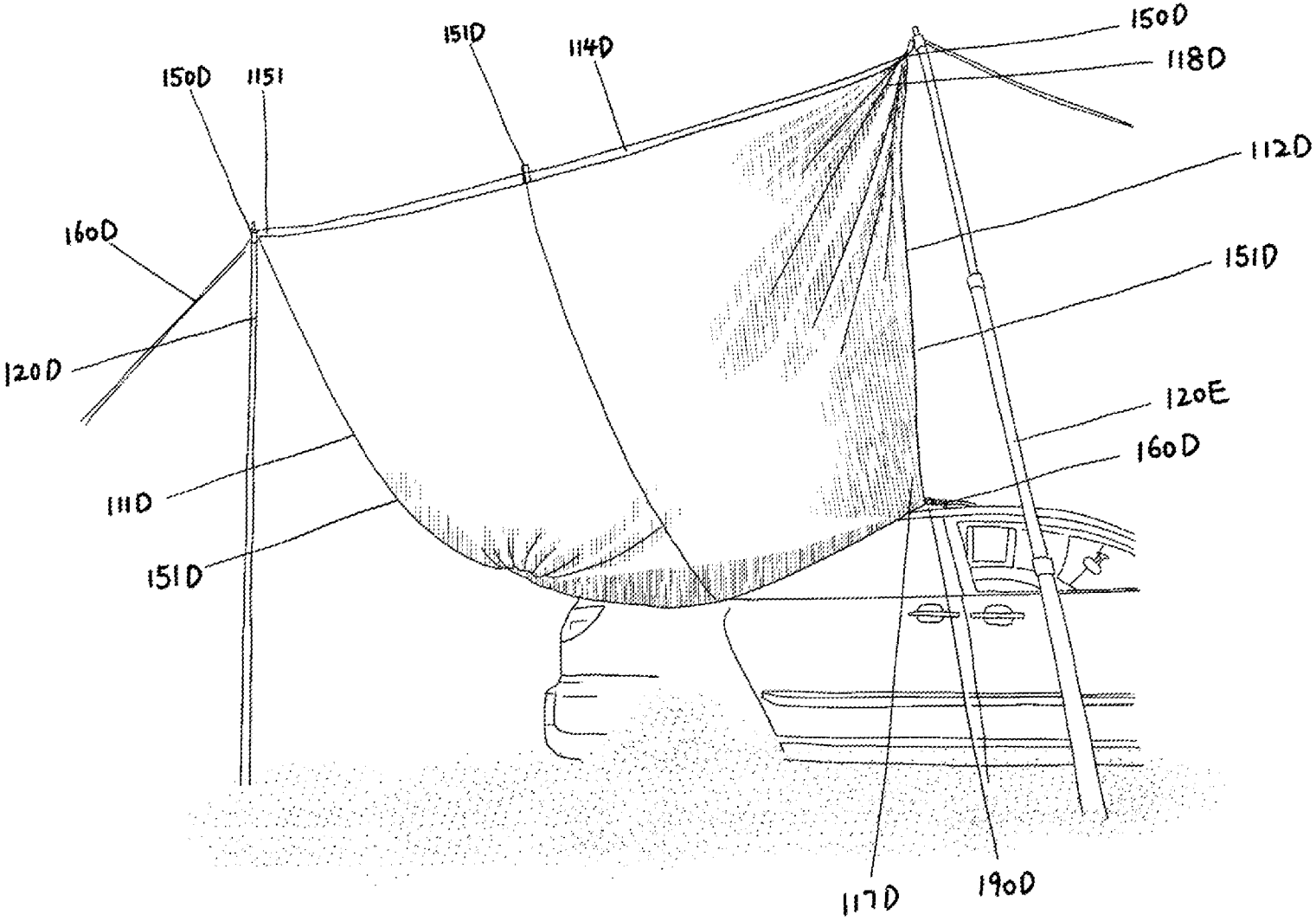
FIG. 8 is a right side view of the multi-purpose shelter of FIG. 7.

FIGS. 7 and 8 generally depict another alternative embodiment of the multipurpose shelter 100D, wherein the multi-purpose shelter 100D comprises a covering 110D having a plurality of corners and a plurality of side edges including a front side edge 111D, a rear side edge 112D parallel with the front side edges 111D, a left side edge 113D vertically arranged with the front side edge 111D and the rear side edge 112D, and a right side edge 114D vertically arranged with the front side edge 111D and the rear side edge 112D, a first rod member 120D having a top end and a bottom end erectly anchored on the surface, and a second rod member 130E parallelly arranged with the first rod member 120D and having a top end and a bottom end erectly anchored on the surface.

Referring now to the detail of FIG. 8, the multi-purpose shelter further comprises a plurality of loop straps 150D spacedly formed on the side edges or each of the side edges of the covering 110D and formed at the corners or each of the corners, wherein the top end of the first rod member 120D and the top end of the second rod member 130E are coupled with the loop straps formed at the corners.

According to the above alternative embodiment, as shown in FIGS. 7 and 8, the corners comprises a first corner 115D, a second corner 116D, a third corner 117D, and a fourth corner 118D, wherein the second corner 116D may be adjacent to the first corner 116D and the third corner 117D, and the third corner 117D may be adjacent to the second corner 116D and the fourth corner 118D, and the third corner 118D may be an across corner with respect to the first corner 115D.

In some embodiments, as shown in FIGS. 7 and 8, the top end of the first rod member 120D may be coupled at the loop strap 150D formed at one of the corners, including a first corner 115D, a second corner 116D, a third corner 117D, and a fourth corner 118D, and the top end of the second rod member 130E may be coupled at the loop strap 150D formed at the corner adjacent to/next to the corner where the top end of the first rod member 120D is coupled thereon.

In some embodiments, as shown in FIGS. 7 and 8, the multi-purpose shelter 100D further comprises a plurality of cord 160D, wherein each of the cords 160D comprises a first end and a second end opposite to the first end, wherein the first end is coupled with the loop straps 150D formed the corners, including the first corner 115D, the second corner 116D, the third corner 117D, and the fourth corner 118D, and the second end is secured on the surface or a support end 190D.

Optionally, as shown in FIGS. 7 and 8, the top end of the first rod member 120D may be coupled at the loop straps 150D formed at the first corner 115D, and the top end of the second rod member 130E may be coupled at the loop straps 150D formed on the second corner 116D, the third corner 117D or the fourth corner 118D. In this way, the cords 160D may be coupled with the loop strap formed at the third corner 117D or second corner 116D, in order to support the covering 110D being expanded and suspended between the support end 190D, the first rod member 120D, and the second rod member 130E.

With specific reference to FIGS. 7 and 8, the plurality of loop straps further comprises at least one middle loop strap 151D, and preferably, the plurality of loop straps comprises at least one middle loop strap 151D, wherein each of the middle loop straps 151D bisects any one of the side edges of the covering 110D. The at least one middle loop straps 151D comprises a front middle loop strap formed on the front side edge of the covering 110D, a right middle loop strap formed on the right side edge of the covering 110D, a left middle loop strap formed on the left side edge of the covering, and a rear middle loop strap formed on the rear side edge of the covering.

In some embodiments, the top end of the first rod member 120D may be coupled on one of the loop strap 150D formed at the corners and the top end of the second rod member 130E may be coupled on at least one of the middle loop strap 151D. In an example, the top end of the first rod member 120D may be coupled at the loop strap formed at the second corner 116D, and the top end of the second rod member 130E may be coupled at the middle loop strap 151D adjacent to/next to the second corner 116D. In this example, the top end of the second rod member 130E may be coupled at the front middle loop strap and/or the left middle loop strap.

According to the above embodiments, the covering described on all of the embodiments of the present invention may comprise the right side edge vertically extended to the front side edge of the covering to form the first corner, the front side edge vertically extended to the left side edge of the covering to form the second corner, the left side edge vertically extended to the rear side edge of the covering to form the third corner, and the rear side edge vertically extended to the right side edge to form the fourth corner, wherein the covering further comprises a plurality of side pockets arranged along at least one of the side edges, including the front side edge, the rear side edge, the right side edge, and the left side edge, and a middle pocket transversely formed across the covering. Alternatively, the middle pocket bisects the covering into two equal area sections.

According to the above embodiments, each of side pockets and each of the middle pockets described in all of the embodiments of the present invention may comprise a portion fabric folded back upon itself and secured to itself to form a hollow space for receiving the first rob member or/and the second rod member.

According to the above embodiments of the covering described in all of the embodiments of the present invention, the front side edge and the rear side edge are the edges without having the side pockets.

According to the above embodiments, the covering described in all of the embodiments of the present invention may be a square or rectangular covering, wherein each of the corners, including the first corner, the second corner, the third corner, and the fourth corner, is formed at the two vertically arranged side edges.

According to the above embodiments, the covering described in all of the embodiments of the present invention may comprise a plurality of loop straps spacedly formed on the side edges or each of the side edges of the covering, including the front side edge, the rear side edge, the right side edge, and the left side edge, and formed at the corners or each of the corners, including the first corner, the second corner, the third corner, and the fourth corner, wherein the plurality of loop straps further comprises at least one middle loop strap, and preferably, the loop straps comprise at least one middle loop strap, wherein each one of the middle loop straps bisects any one of the side edges of the covering. The at least one middle loop straps comprises a front middle loop strap formed on the front side edge of the covering, a right middle loop strap formed on the right side edge of the covering, a left middle loop strap formed on the left side edge of the covering, and a rear middle loop strap formed on the rear side edge of the covering.

According to the above embodiments, each of the first and second rod members described in all of the embodiments of the present invention may comprise the forward end and the backward end opposite to the forward end and be sufficiently flexible to permit the forward end and the backward end to be bent down and secured on the surface, wherein each of the first rod members and the second rod members may comprise a plurality of elongated rod segments in a collapsed or foldable condition. Each of the elongated rod segments may be a hollow tube having a supporting portion and an engaging portion formed at one end of the supporting portion, wherein a diameter of the engaging portion is smaller than a diameter of the supporting portion, wherein the engaging portion is telescopically received within the supporting portion to form the first rod member or the second rod member. In this way, an elastic cord extends continuously through the elongated rod segments and is secured to each end of the elongated rod segments.

According to the above embodiments, each of the first and second rod member described in all of the embodiments of the present invention may be two identical rod which comprises a diameter from three-fourths inches to five-sixteenth inches. It should be noted that the elongated rod segments may be made of a material selected from a group consisting of PVC, CPVC, PEX, copper, iron, polyethylene, ABS, and galvanized steel. The contemplated elongated rod segments can be made of suitable materials to withstand temperature extreme and the chemical environment, such materials include natural and synthetic polymers, various metals and metal alloys, and all reasonable combinations thereof.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the multi-purpose shelter have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Referring to FIG. 9 to FIG. 16 of the drawings, a multi-purpose shelter 100' according to a second preferred embodiment of the present invention is illustrated. Broadly, the multi-purpose shelter 100' may comprise a covering fabric 110', a first rod member 120', a plurality of cords 162', and at least one weight member 50'.

The covering fabric 110' may have a plurality of side edges 111', and a first pocket 61' extending along a transverse direction of the covering fabric 110'.

The first rod member 120' may have a first forward end 121', a first backward end 122', and a first main portion 123' extending between the first forward end 121' and the first backward end 122'. At least part of the first main portion 123' may pass through the first pocket 61' of the covering fabric 110', and may be folded to form a curved contour (e.g. an arc-shaped contour) between the first forward end 121' and the first backward end 122' so as to be erected on a support surface.

Each of the plurality of cords 162' may have a first end portion 1621' detachably connected to one of the side edges 111' of the covering fabric 110', and a second end portion 1622' affixed on the support surface at a predetermined angle. Each of the cords 162' may be stretched to establish a predetermined amount of tension for pulling the covering fabric 110'.

The weight member 50' may be detachably attached on one of the first forward end 121' and the first backward end 122' of the first rod member 120' for providing a secure support to the multi-purpose shelter 100' on the support surface. The covering fabric 110' may be supported by the first rod member 120' and stretched by the cords 162' to form a shelter space underneath the covering fabric 110'.

According to the second preferred embodiment of the present invention, the multi-purpose shelter 100' may be erected on a support surface. The support surface may be designated as those surfaces which may be penetrated by a pin, a rod or any elongated metallic or non-metallic structure, such as tent pegs 200', nails, hooks, or the likes. The support surface must be secure enough to support the multi-purpose shelter 100', while a surface structure of the support surface must be soft enough to allow the above-mentioned object to penetrate it so as to provide an anchor to the whole multi-purpose shelter 100'. Exemplary support surfaces include sands, grasslands etc.

The covering fabric 110' may be configured from durable and waterproof yet flexible and foldable material such that the covering fabric 110' may be extended to form a shelter and create the shelter space there underneath, or folded into a compact size. It is worth mentioning that the shape of the covering fabric 110' may be varied depending on the circumstances in which the present invention is manufactured. For example, the covering fabric 110' may have a square or rectangular cross section when viewed from the top, wherein each of the side edges 111' of the covering fabric 110' may intersect with adjacent side edge 111' to form a corresponding corner portion 112'. In this second preferred embodiment, the covering fabric 110' may have four corner portions 112' and four side edges 111' for forming a quadrilateral shape.

According to the second preferred embodiment of the present invention, the first pocket 61' may extend along a transverse direction of the covering fabric 110'. More specifically, the first pocket 61' may be elongated in shape and may extend between two opposite side edges 111' of the covering fabric 110'. Depending on the actual shape of the covering fabric 110', the first pocket 61' may be parallel to the side edges 111' along a transverse direction of the covering fabric 110'. In the case that the covering fabric 110' has a circular cross section, the first pocket 61' may extend along an imaginary line which extending through the diameter of the covering fabric 110'. The first pocket 61' may have two first pocket openings 611' formed at two ends of the first pocket 61' respectively wherein the first rod member 120' may penetrate the first pocket 61' through the first pocket openings 611'.

Figure 14:
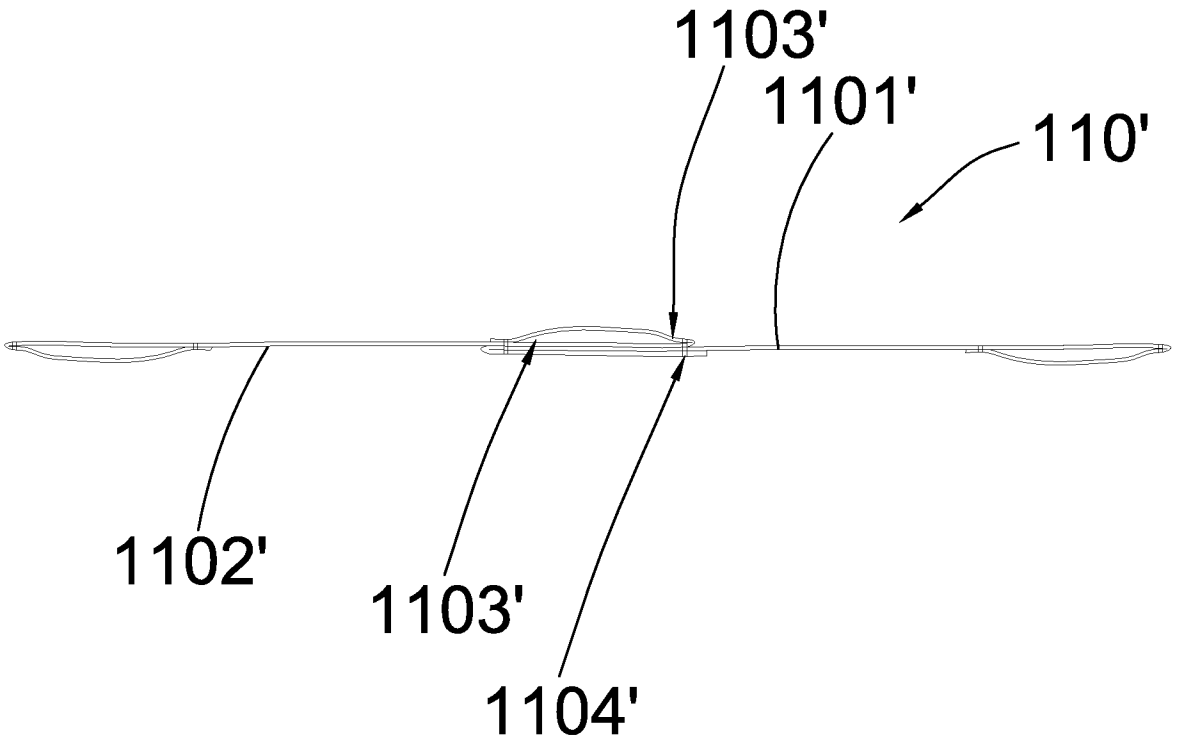
FIG. 14 is a schematic diagram of the covering fabric of the multi-purpose shelter according to the second preferred embodiment of the present invention, illustrating that the covering fabric may be formed by two fabric members.

Referring to FIG. 14 of the drawings, the covering fabric 110' may comprise a first fabric member 1101' and a second fabric member 1102'. Each of the first fabric member 1101' and the second fabric member 1102' may have an inner stitching rim 1103', wherein the stitching rims 1103' may be overlapped with each other and stitched together by two spacedly apart stitching threads 1104' so as to form the first pocket 61' between the two stitching threads 1104'. Note that the inner stitching rims 1103' may be formed along an inner side edge of each of the first fabric member 1101' and the second fabric member 1102' so that the first pocket 61' may be arranged to bisect the covering fabric 110'. In other words, the first pocket 61' may extend along a mid-portion 1105' of the covering fabric 110'.

Thus, the first pocket 61' may bisect the covering fabric 110' into two equal area sections formed by the first fabric member 1101' and the second fabric member 1102' respectively. The first rod member 120' may be loosely received in the first pocket 61', wherein the first forward end 121' and the first backward end 122' may be secured or anchored to a support surface preferably at an acute angle with respect to the support surface.

The multi-purpose shelter 100' may further comprise a plurality of (but at least one) loop straps 150' spacedly formed on the side edges 111' of the covering fabric 110', wherein the first end portion 1621' of the each of cords 162' may be detachably fastened to one of the loop straps 150' so as to detachably connect to the corresponding side edge 111' of the covering fabric 110'. Note that the number and the positions of the loop straps 150' may be varied according to the circumstances in which the present invention is manufactured. In this second preferred embodiment, four loop straps 150' may be formed on four corner portions 112' of the covering fabric 110' respectively.

Figure 9:
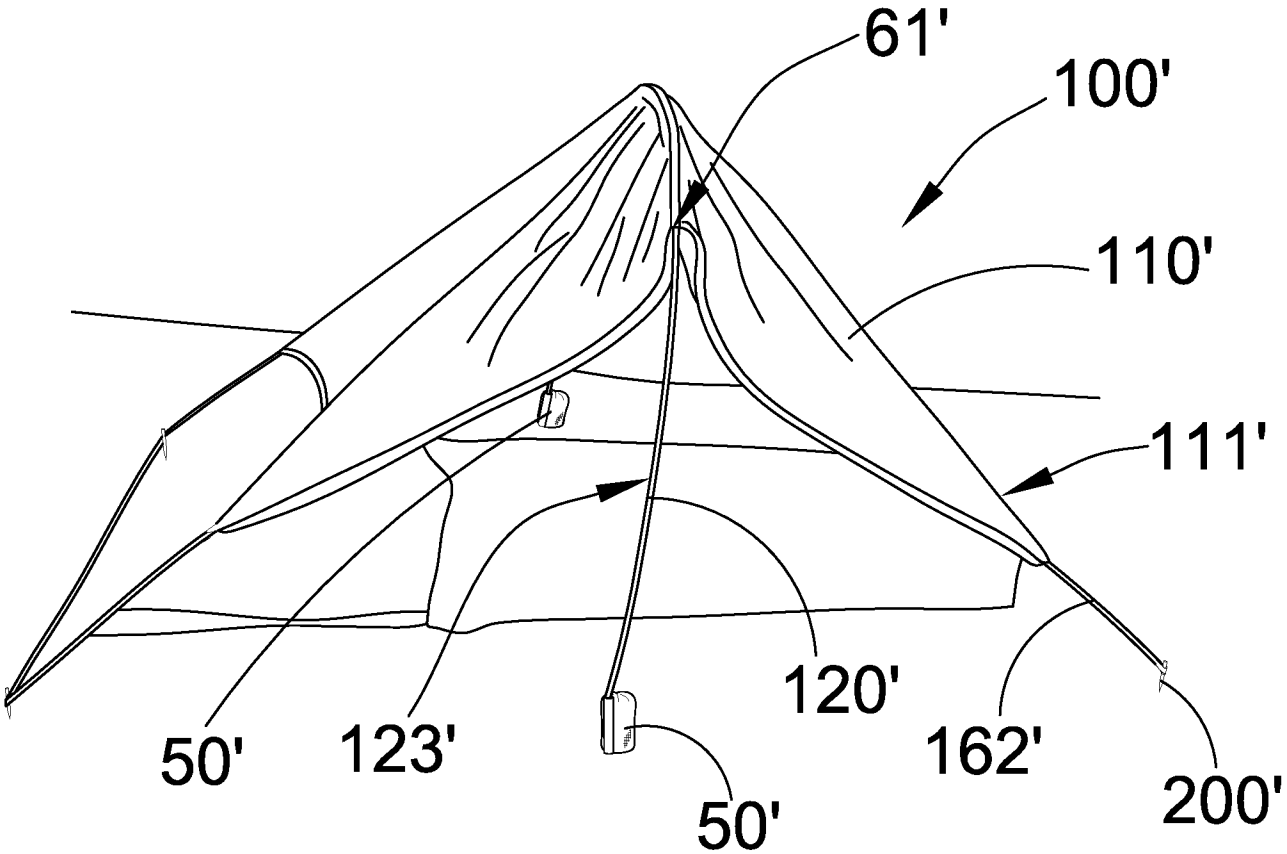
FIG. 9 is a front perspective view of a multi-purpose shelter according to a second preferred embodiment of the present invention.
Figure 10:
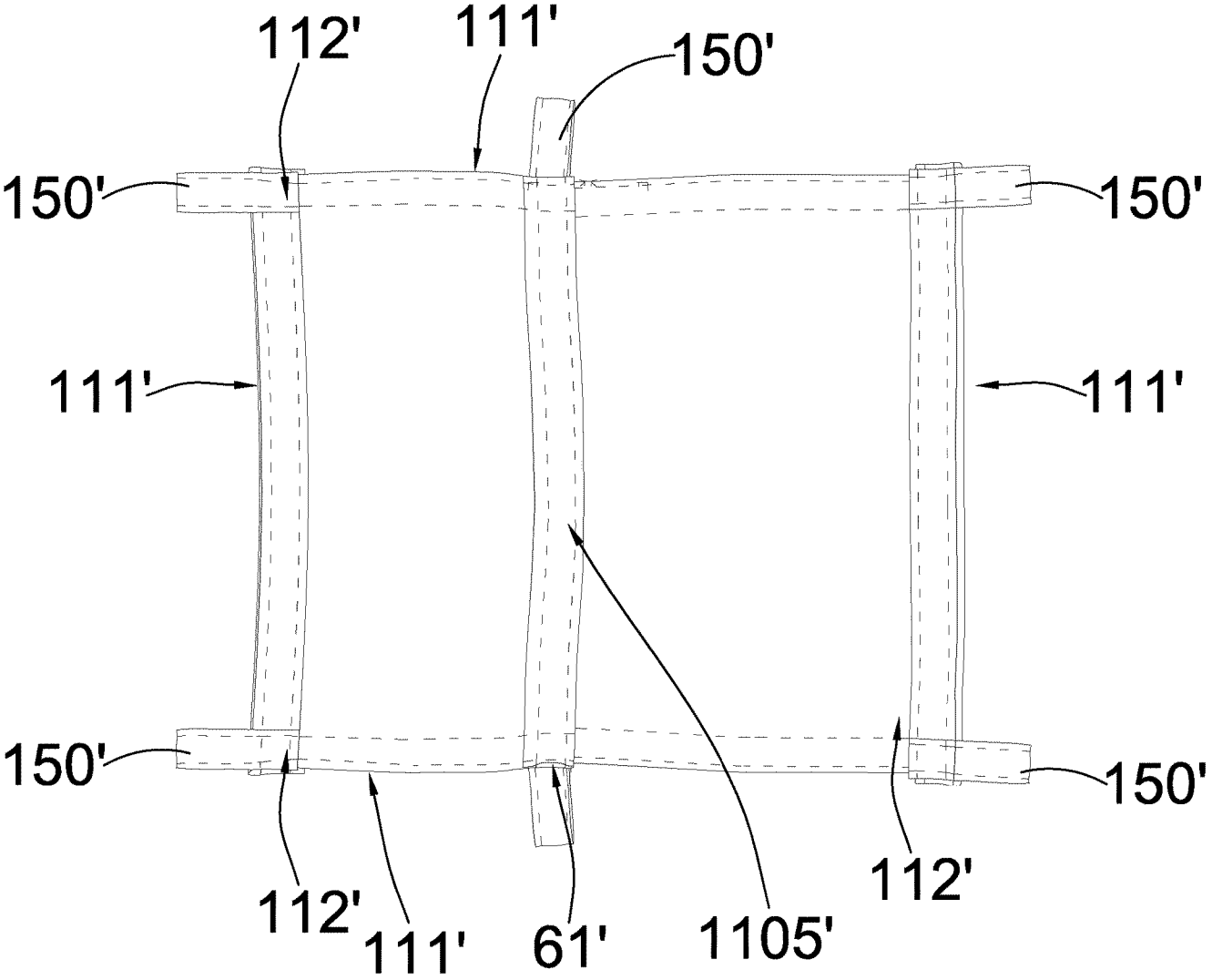
FIG. 10 is a schematic diagram of a covering fabric of the multi-purpose shelter according to a second preferred embodiment of the present invention.
Figure 11:
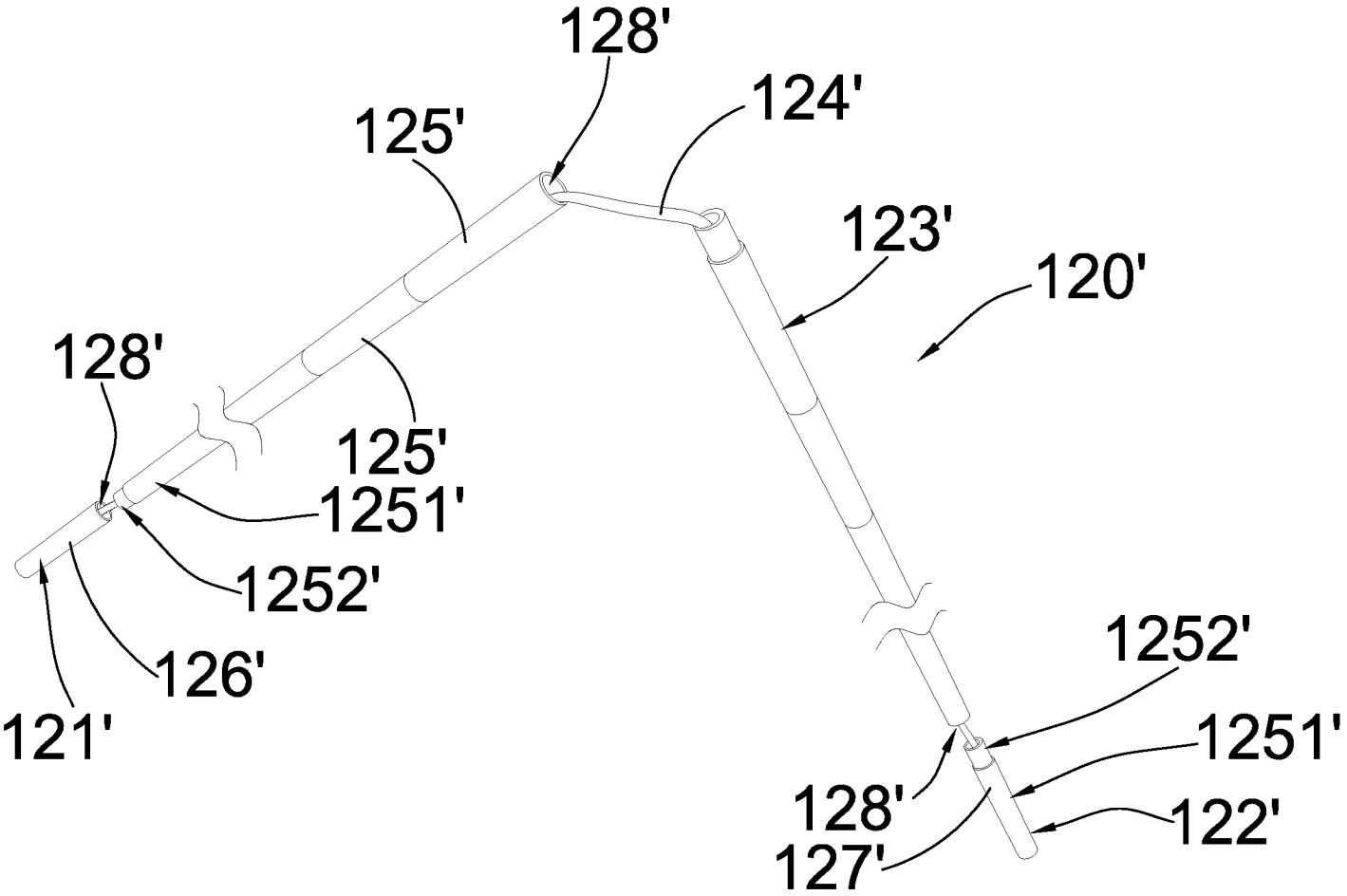
FIG. 11 is a schematic diagram of a first rod member of the multi-purpose shelter according to the second preferred embodiment of the present invention.
Figure 12:
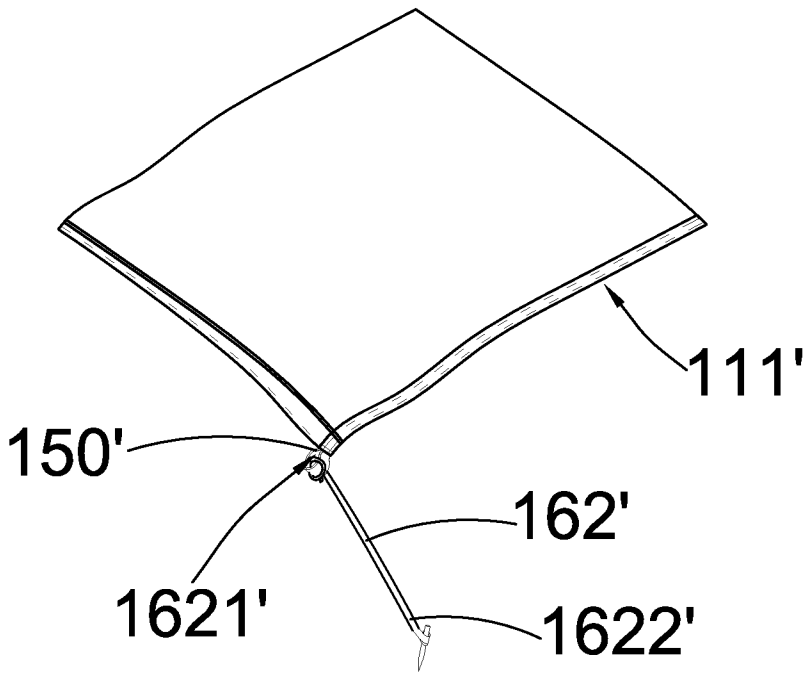
FIG. 12 is a schematic diagram of a cord connecting to the covering fabric of the multi-purpose shelter according to the second preferred embodiment of the present invention.
Figure 13:
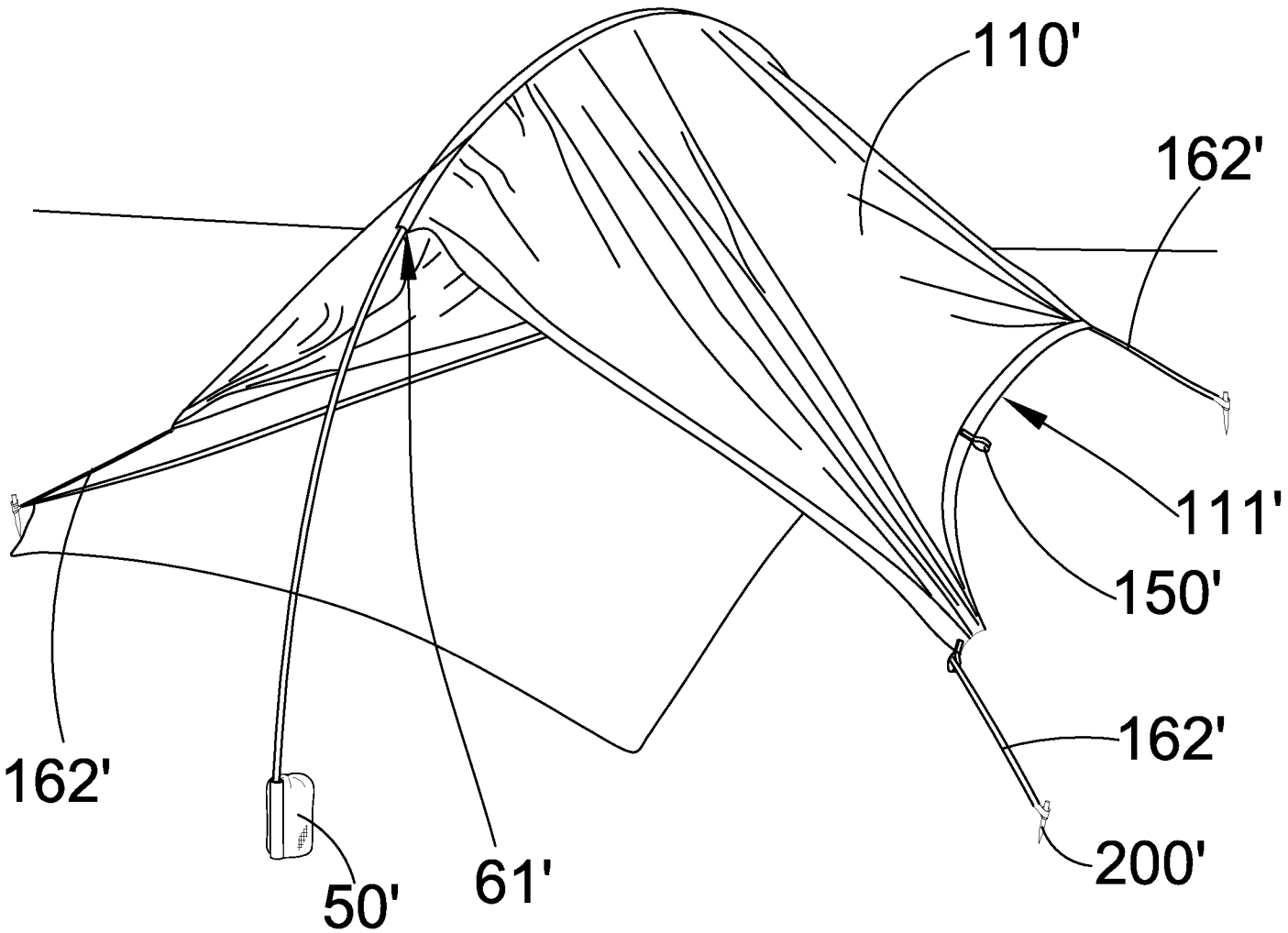
FIG. 13 is a rear perspective view of the multi-purpose shelter according to the second preferred embodiment of the present invention.

Referring to FIG. 9, FIG. 11 and FIG. 13 of the drawings, the first rod member 120' may be sufficiently flexible to permit the first forward end 121' and the first backward end 122' to be bent down and secured on the surface. Specifically, the first rod member 120' may comprise a first connecting cord 124' having a predetermined elasticity, a first end segment 126', a second end segment 127', and a plurality of first connecting rod segments 125', wherein the first forward end 121' and the first backward end 122' may be formed on the first end segment 126' and the second end segment 127' respectively. Each of the first end segment 126', the second end segment 127', and the first connecting rod segments 125' may have a hollow structure having a first central cavity 128'. The first connecting cord 124' may be accommodated in the first central cavities 128' and extend through the first end segment 126', the second end segment 127', and the plurality of first connecting rod segments 125'.

Each of the first connecting rod segments 125' may be detachably attached to an adjacent first connecting rod segment 125'. Thus, as shown in FIG. 11 of the drawings, each of first end segment 126', the second end segment 127' and the first connecting rod segments 125' may have a first main section 1251' and a first contracted section 1252', in which an outer diameter of the first contracted section 1252' is smaller than that of the corresponding first main section 1251'. In order to detachably connect each two adjacent first connecting rod segments 125', the first contracted section 1252' of a first connecting rod segment 125' may be arranged to insert into the first main section 1251' of an adjacent first connecting rod segment 125' in a conveniently detachable manner, while the first contracted section 1252' of the second end segment 127' may also be inserted into the first main section 1251' of an adjacent first connecting rod segment 125'.

Each of the first end segment 126', the second end segment 127', and the first connecting rod segment 125' may be configured from metallic or metallic alloy material and may have a predetermined of flexibility may be able to slightly deform and return to original shape. For example, the first connecting rod segments 125', the first end segment 126' and the second end segment 127' may be made of a material selected from a group consisting of PVC, CPVC, PEX, copper, iron, polyethylene, ABS, and galvanized steel.

According to the second preferred embodiment, each of the first end segment 126' and the second end segment 127' may be detachably connected to an adjacent first connecting rod segment 125' while each two adjacent first connecting rod segments 125' may detachably connect with each other in the manner described in the preceding paragraph. When the first end segment 126', the second end segment 127' and the first connecting rod segments 125' are connected, the entire first rod member 120' may pass through the first pocket 61' and may be slightly bent to form a curvature so as to form the curved contour (e.g. an arc-shaped contour) of the first rod member 120'. The first main portion 123' may be collectively formed by the first connecting rod segments 125'.

As mentioned above, the first connecting cord 124' may extend through the first end segment 126', the second end segment 127' and all first connecting rod segments 125' so as to loosely connect or bind them in a correct sequence. When the first rod member 120' is not in use and detached from the covering fabric 110', each of the first end segment 126' and the second end segment 127' may be detached from the adjacent first connecting rod segment 125', while all first connecting rod segments 125' may be detached from each other. Since the first end segment 126', the second end segment 127' and all first connecting rod segments 125' are connected with the first connecting cord 124', the first end segment 126', the second end segment 127' and all first connecting rod segments 125' may then be folded into a compact size. A user simply needs to conveniently connect the first end segment 126', the second end segment 127' and all first connecting rod segments 125' in the manner described above when he wishes to erect the multi-purpose shelter 100' again. The first end segment 126', the second end segment 127' and all first connecting rod segments 125' will not get lost. The first connecting cord 124' may have a predetermined elasticity so as to facilitate easy bending and folding of the first rod member 120'.

Figure 15:
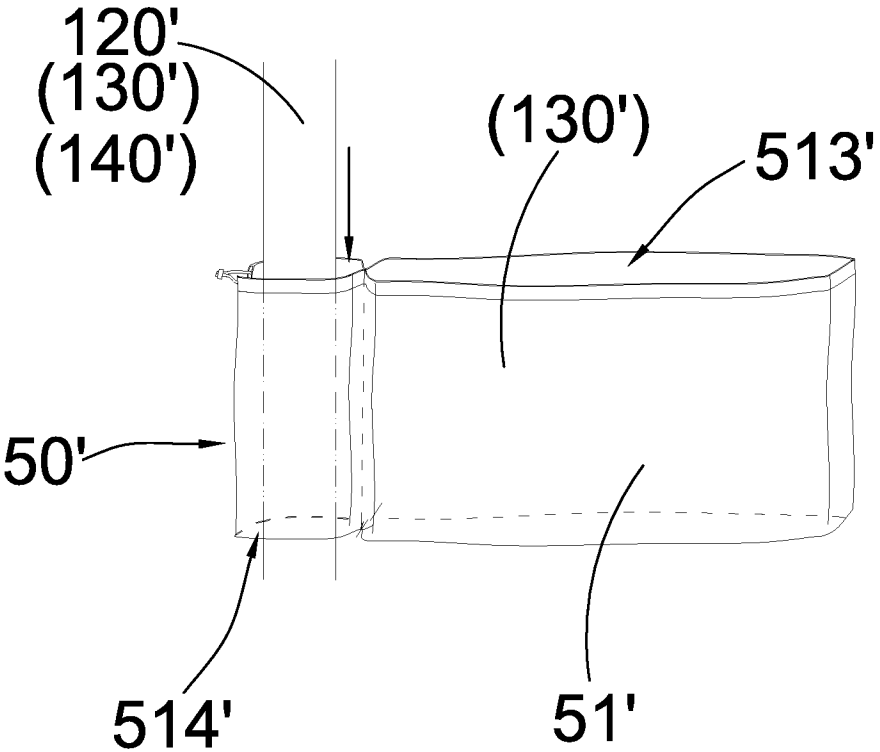
FIG. 15 is a perspective view of a weight member of the multi-purpose shelter according to the second preferred embodiment of the present invention.
Figure 16:
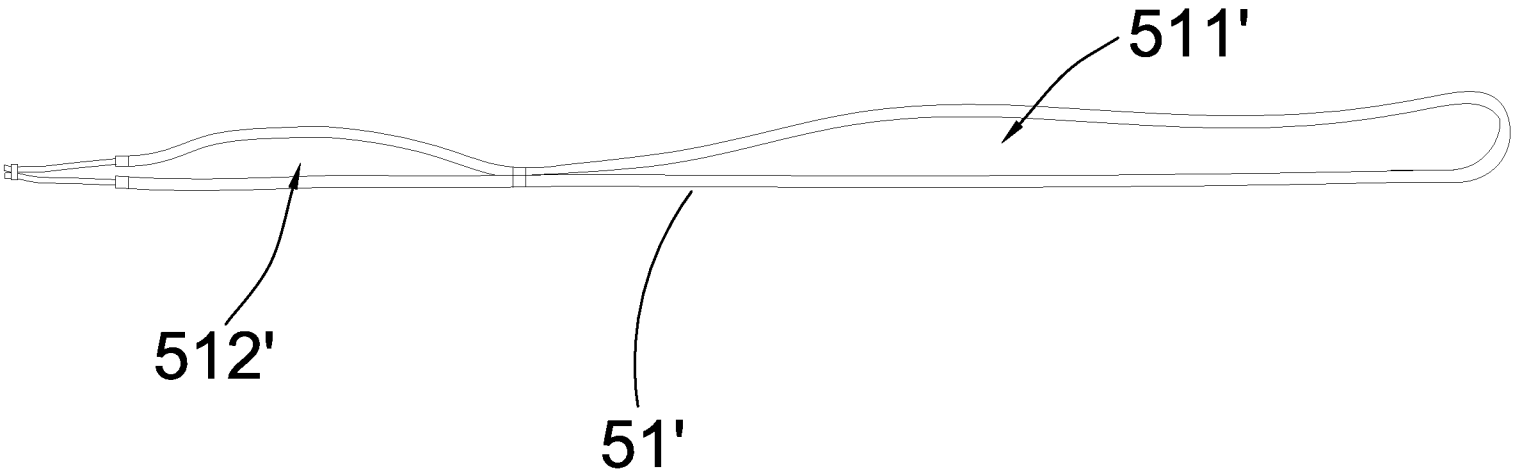
FIG. 16 is a schematic diagram of the weight member of the multi-purpose shelter according to the second preferred embodiment of the present invention.

Furthermore, as shown in FIG. 15 and FIG. 16 of the drawings, the weight member 50' may comprise a weight container 51' having a storage compartment 511', a securing compartment 512' and a top opening 513' communicating the storage compartment 511' and the securing compartment 512' to an exterior of the weight container 51'. The weight container 51' may be made from light, flexible and deformable material such as fabric or plastic material so that when the weight container 51' is empty, it may be collapsed into compact size and may be easily transported.

According to the second preferred embodiment of the present invention, the storage compartment 511' may be a closed end compartment so that the storage compartment 511' can only communicate to an exterior of the weight container 51' through the top opening 513'. It is important to mention that the storage compartment 511' may be arranged to accommodate or store weight objects so as to provide an anchor to the multi-purpose shelter 100'. The weight objects may be sands, stones or other suitable objects and do not form part of the present invention. However, a user will be able to manually dispose a suitable amount of weight objects in the storage compartment 511'.

On the other hand, the securing compartment 512' may extend through a longitudinal direction of the weight container 51' and may be provided side-by-side with the storage compartment 511'. The securing compartment 512' may be accessed by the top opening 513' of the weight container 51', while at the same time, the securing compartment 512' may further have a bottom opening 514', wherein the first rod member 120' may be arranged to penetrate through the securing compartment 512' and affixed on the support surface.

According to the second preferred embodiment of the present invention, the multi-purpose shelter 100' may comprise two weight members 50' in which the weight members 50' may be attached on the first end segment 126' and the second end segment 127' of the first rod member 120' respectively for providing anchor to the first rod member 120'. Thus, each of the first end segment 126' and the second end segment 127' may be arranged to penetrate the corresponding securing compartment 512' and affixed on the support surface.

The plurality of cords 162' may be utilized to stretch the covering fabric 110' in a tensioned manner so as to create the shelter space. A user may be able to determine how many cords 162' are needed to achieve his or her outdoor purpose. Referring to FIG. 9 and FIG. 13 of the drawings, the multi-purpose shelter 100' may utilize four cords 162' each having one end detachably affixed to the corresponding loop strap 150' of the covering fabric 110', while the other end may be detachably affixed to the support surface, preferably through a tent peg 200'.

During the uses of the multi-purpose shelter 100', the plurality of cords 162' may be affixed to the loop straps 150' provided on the corner portions 112' of the covering fabric 110' so as to stretch the covering fabrics 110' from four corner portions 112' thereof. The cords 162' may be configured as having a predetermined strength and elasticity to maintain the multi-purpose shelter 100' in the erected configuration.

The operation of the present invention is as follows: when the multi-purpose shelter 100' of the present invention is not in use, the covering fabric 100' and the first rod member 120' may be folded into compact size for easy storage. Moreover, the weight containers 51' may be emptied and also folded into compact size. As such, the entire set of multi-purpose shelter 100' may be put in a very compact package for ease of carrying or transportation.

When a user wishes to set up the multi-purpose shelter 100' of the present invention, the user may just need to unfold the first rod member 120' and assemble each of the first connecting rod segments 125' with an adjacent first connecting rod segment 125', and connect the first end segment 126' and the second end segment 127' to the corresponding adjacent first connecting rod segments 125' respectively. The connections between each of first connecting rod segments 125' and between the first end segment 126' and the corresponding first connecting rod segment 125' and between the second end segment 127' and the corresponding first connecting rod segment 125' have been described in the preceding paragraphs. The user may then insert the first rod member 120' into the first pocket 61' from one of the first pocket openings 611' and penetrate through the first pocket 61'.

After that, the user may then manually put weight objects in the storage compartments 511' of the weight members 50', and assemble the two weight members 50' on the first forward end 121' and the first backward end 122' of the first rod member 120' by penetrating the first end segment 126' and the second end segment 127' through the securing compartments 512' respectively. The user may then insert the first end segment 126' and the second end segment 127' in the support surface at a predetermined angle for securing the first rod member 120' and the covering fabric 110' on the support surface.

After that, the user may connect the first end portion 1621' of each of the cords 162' to one of the loop straps 150', extend and pull the cords 162' and affix the second end portion 1622' of each of the cords 162' to the support surface through the tent pegs. The multi-purpose shelter 100' may then be erected in the configuration as shown in FIG. 9 of the drawings.

In this configuration, the highest point of the multi-purpose shelter 100' may be configured as the area around the first pocket 61', wherein the covering fabric 110' may then downwardly and inclinedly extend toward the two side edges 111'.

A further feature of the multi-purpose shelter 100' thus described is that the surface covered by the covering fabric 110' may be adjusted by the acute angle formed by first rod member 120' with respect to the support surface and the angles formed by the cords 162' with respect to the support surface. In this case, a larger acute angle, preferably larger than 45 degrees, formed by each of the forward end 121' and the backward end 122' of the first rod member 120' with the support surface and larger angles, preferably larger than 45 degrees, formed by the cords 162' with respect to the support surface may generate a smaller shelter space. In the other words, a smaller acute angle, preferably less than 45 degrees, formed by each of the forward end 121' and the backward end 122' of the first rod member 120' with respect to the support surface and smaller angles, preferably less than 45 degrees, formed by the cords 162' with respect to the support surface may generate a larger shelter space.

Figure 17:
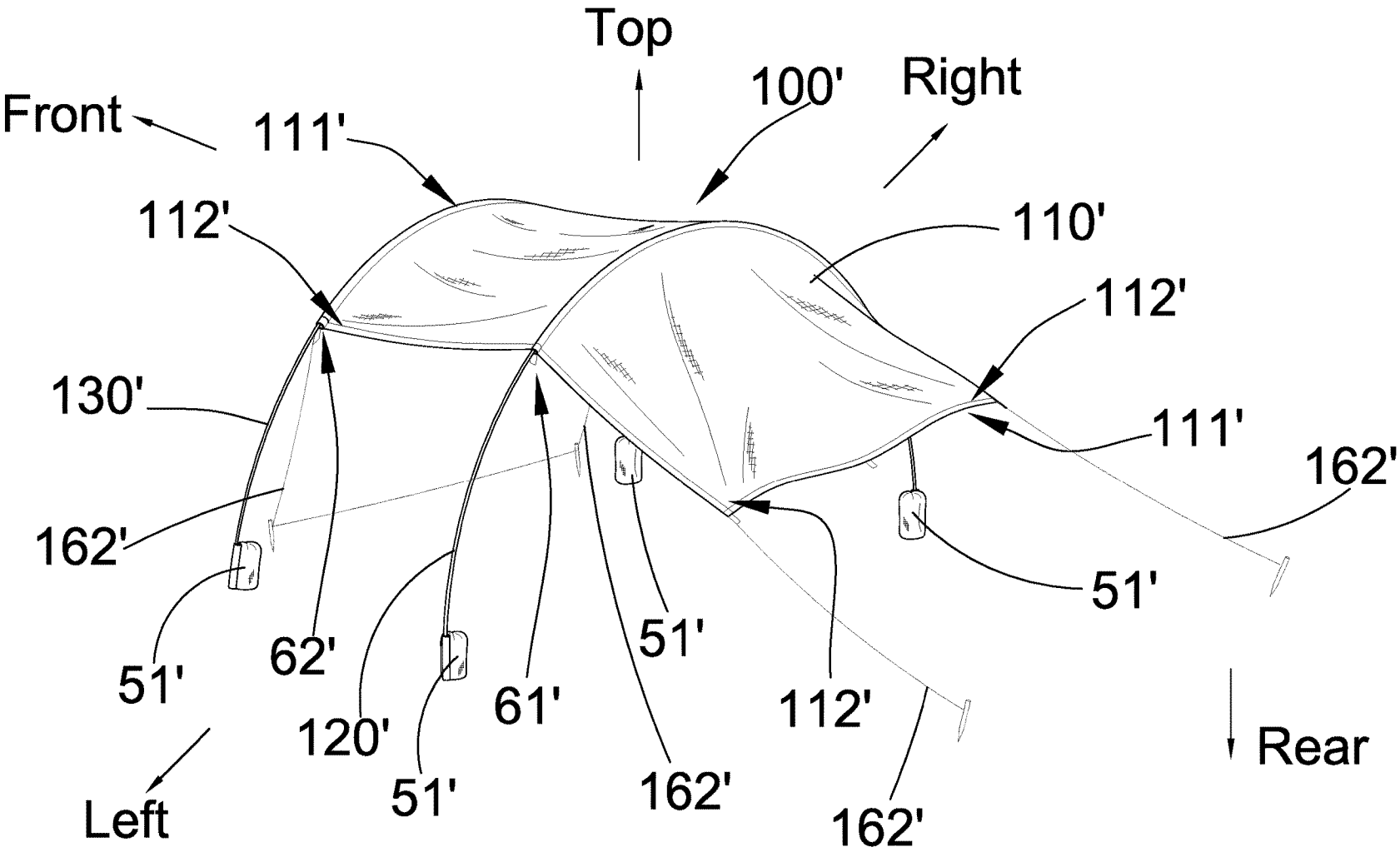
FIG. 17 is a first alternative mode of the multi-purpose shelter according to the second preferred embodiment of the present invention.
Figure 18:
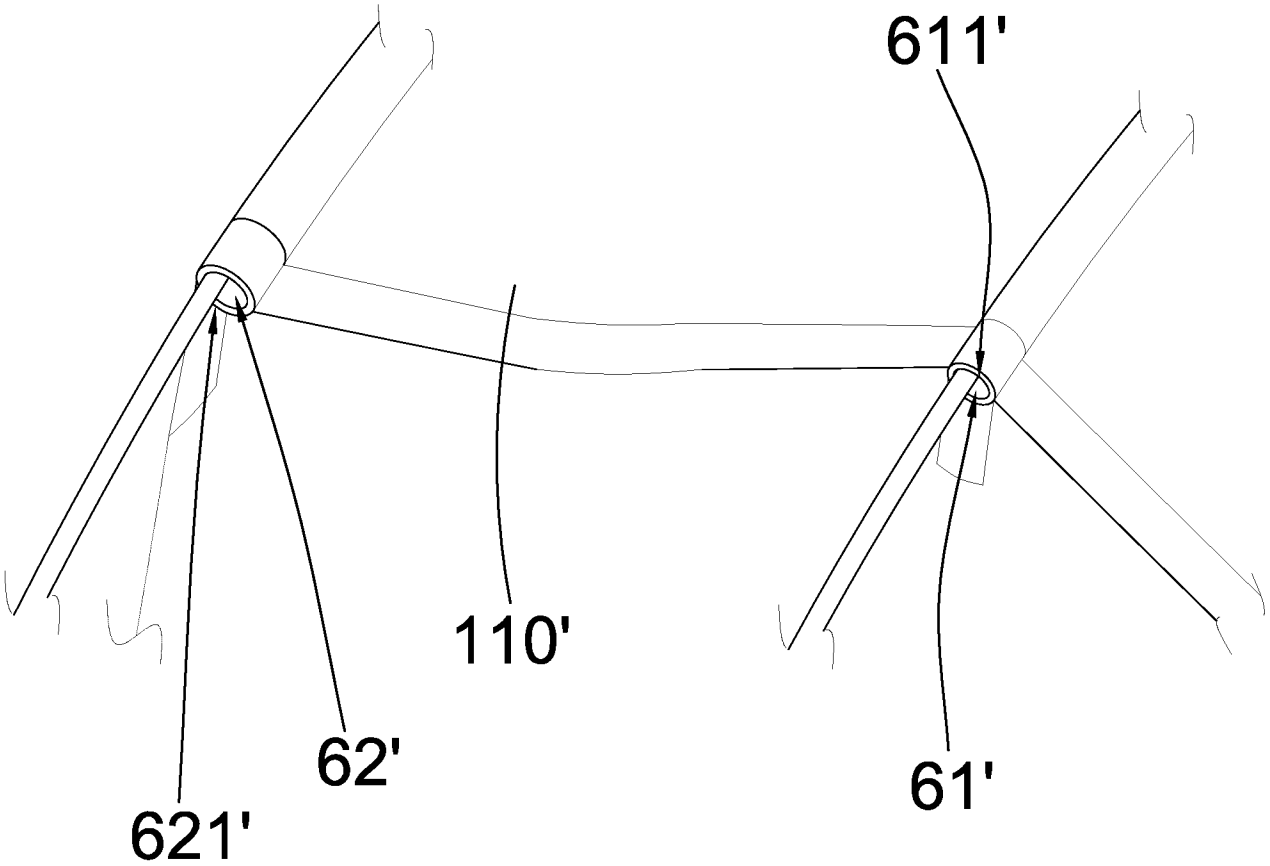
FIG. 18 is a partially enlarged view of the multi-purpose shelter according to the first alternative mode of the second preferred embodiment of the present invention.
Figure 19:
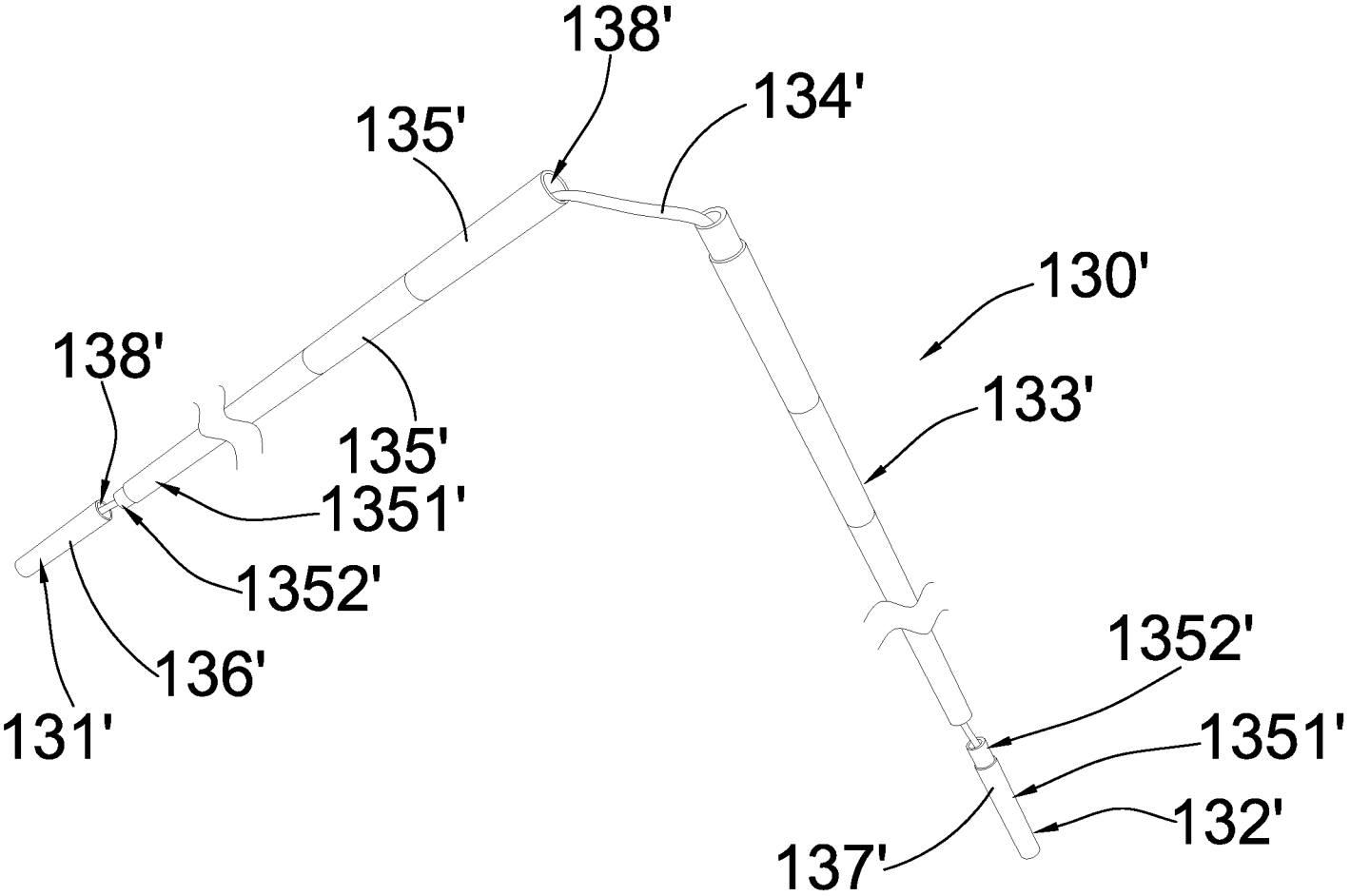
FIG. 19 is a perspective view of a second rod member of the multi-purpose shelter according to the first alternative mode of the second preferred embodiment of the present invention.

Referring to FIG. 17 to FIG. 19 of the drawings, a first alternative mode of the multi-purpose shelter 100' according to the second preferred embodiment of the present invention is illustrated. The first alternative mode is an alternative configuration of the multi-purpose shelter 100'. According to the first alternative mode of the second preferred embodiment, the covering fabric 110' may further have a second pocket 62' extended along a transverse direction of the covering fabric 110' at a position space apart from the first pocket 61'. The second pocket 62' may be structurally identical to the first pocket 61' and may have two second pocket openings 621' formed at two ends of the second pocket 62' respectively. The multi-purpose shelter 100' may further comprise a second rod member 130' arranged to detachably penetrate through the second pocket 62'.

As shown in FIG. 19 of the drawings, the second rod member 130' may be structurally identical to the first rod member 120'. The purpose of the second rod member 130' is to support the covering fabric 110' at different positions so that the multi-purpose shelter 100' may be erected in different configuration than that of the second preferred embodiment described above.

The second rod member 130' may have a second forward end 131', a second backward end 132', and a second main portion 133' extending between the second forward end 131' and the second backward end 132'. At least part of the second main portion 133' may pass through the second pocket 62' of the covering fabric 110', and may be folded to form a curved contour (e.g. an arc-shaped contour) between the second forward end 131' and the second backward end 132' so as to be erected on a support surface.

The second rod member 130' may also be configured as flexible to permit the second forward end 131' and the second backward end 132' to be bent down and secured on the support surface.

The second rod member 130' may comprise a second connecting cord 134' having a predetermined elasticity, a third end segment 136', a fourth end segment 137', and a plurality of second connecting rod segments 135', wherein the second forward end 131' and the second backward end 132' may be formed on the third end segment 136' and the fourth end segment 137' respectively. Each of the third end segment 136', the fourth end segment 137', and the second connecting rod segments 135' may form a hollow structure having a second central cavity 138'. The second connecting cord 134' may be accommodated in the second central cavities 138' and extend through the third end segment 136', the fourth end segment 137', and the plurality of second connecting rod segments 135'.

Each of the second connecting rod segments 135' may be detachably attached to an adjacent second connecting rod segment 135'. Thus, each of third end segment 136', the fourth end segment 137' and the second connecting rod segments 135' may have a second main section 1351' and a second contracted section 1352', in which an outer diameter of the second contracted section 1352' is smaller than that of the corresponding second main section 1351'. In order to detachably connect each two adjacent second connecting rod segments 135', the second contracted section 1352' of a second connecting rod segment 135' may be arranged to insert into the second main section 1351' of an adjacent second connecting rod segment 135' in a conveniently detachable manner.

The second contracted section 1352' of the third end segment 136' may be inserted into the second main section 1351' of an adjacent second connecting rod segment 135' while the second contracted section 1352' of the fourth end segment 137' may also be inserted into the second main section 1351' of an adjacent second connecting rod segment 135'. Each of the third end segment 136', the fourth end segment 137', and the second connecting rod segments 135' may be configured from metallic or metallic alloy material and may have a predetermined of flexibility may be able to slightly deform and return to original shape.

Each of the third end segment 136' and the fourth end segment 137' may be detachably connected to an adjacent second connecting rod segment 135' while each two adjacent second connecting rod segments 135' may detachably connect with each other in the manner described in the preceding paragraphs. When the third end segment 136', the fourth end segment 137' and the second connecting rod segments 135' are connected, the entire second rod member 130' may pass through the second pocket 62' and may be slightly bent to form a curvature so as to form the curved contour (such as an arc-shaped contour) of the second rod member 130'. One skilled in the art may appreciate that the second forward end 131' may be formed on the third end segment 136' while the second backward end 132' may be formed on the fourth end segment 137'. Moreover, the second main portion 133' may be collectively formed by the second connecting rod segments 135'.

The second connecting cord 134' may extend through the third end segment 136', the fourth end segment 137' and all second connecting rod segments 135' so as to loosely connect or bind them in a correct sequence. When the second rod member 130' is not in use and detached from the covering fabric 110', each of the third end segment 136' and the fourth end segment 137' may be detached from the adjacent second connecting rod segments 135', while all second connecting rod segments 135' may be detached from each other. The third end segment 136', the fourth end segment 137' and all second connecting rod segments 135' may then be folded into a compact size. The second connecting cord 134' may also have a predetermined elasticity so as to facilitate easy bending and folding.

According to the first alternative mode of the second preferred embodiment, the second pocket 62' may be formed along one of the side edges 111' of the covering fabric 110', so that both the first rod member 120' and the second rod member 130' may support the covering fabric 110' in a suspended manner and form a top ceiling of the shelter space. The first pocket 61' and the second pocket 62' may be substantially parallel with each other. Each of the first rod member 120' and the second rod member 130' may be bent to form a curved contour resembling an arc shape.

In order to set up the multi-purpose shelter in the configuration shown in FIG. 17 of the drawings, the cords 162' may connect the four corner portions 112' of the covering fabric 110' to the support surface by attaching one end of the cords 162' to one of the corner portions 112' and another end of the cords 162' to the support surface. The cords 162' must be stretched to create a predetermined of tension so as to pull the covering fabric 110' toward the support surface. As such, a portion of the covering fabric 110' may be suspendedly supported between the first rod member 120' and the second rod member 130', while another portion of the covering fabric 110' may downwardly and inclinedly extend from the first rod member 120' towards the support surface.

In this first alternative mode, the multi-purpose shelter 100' may comprise four weight members 50' in which the weight members 50' may be attached on the first end segment 126' and the second end segment 127' of the first rod member 120', and the third end segment 136' and fourth end segment 137' of the second rod member 130' respectively for providing anchor to the first rod member 120' and the second rod member 130'. The structure of each of the weight members 50' has been described in the second preferred embodiment above. The third end segment 136' and the second end segment 137' may be arranged to penetrate through the securing compartments 512' of the corresponding weight containers 51' respectively.

As shown in FIG. 17 of the drawings, depending on the size of the covering fabric 110', the covering fabric 110' may form a shelter space which covers a top side, a left side, a right side, and a rear side of the multi-purpose shelter 100'. As a result, only the front side of the multi-purpose shelter 100', which forms an entry or exit of the shelter space, may be left uncovered.

Figure 20:
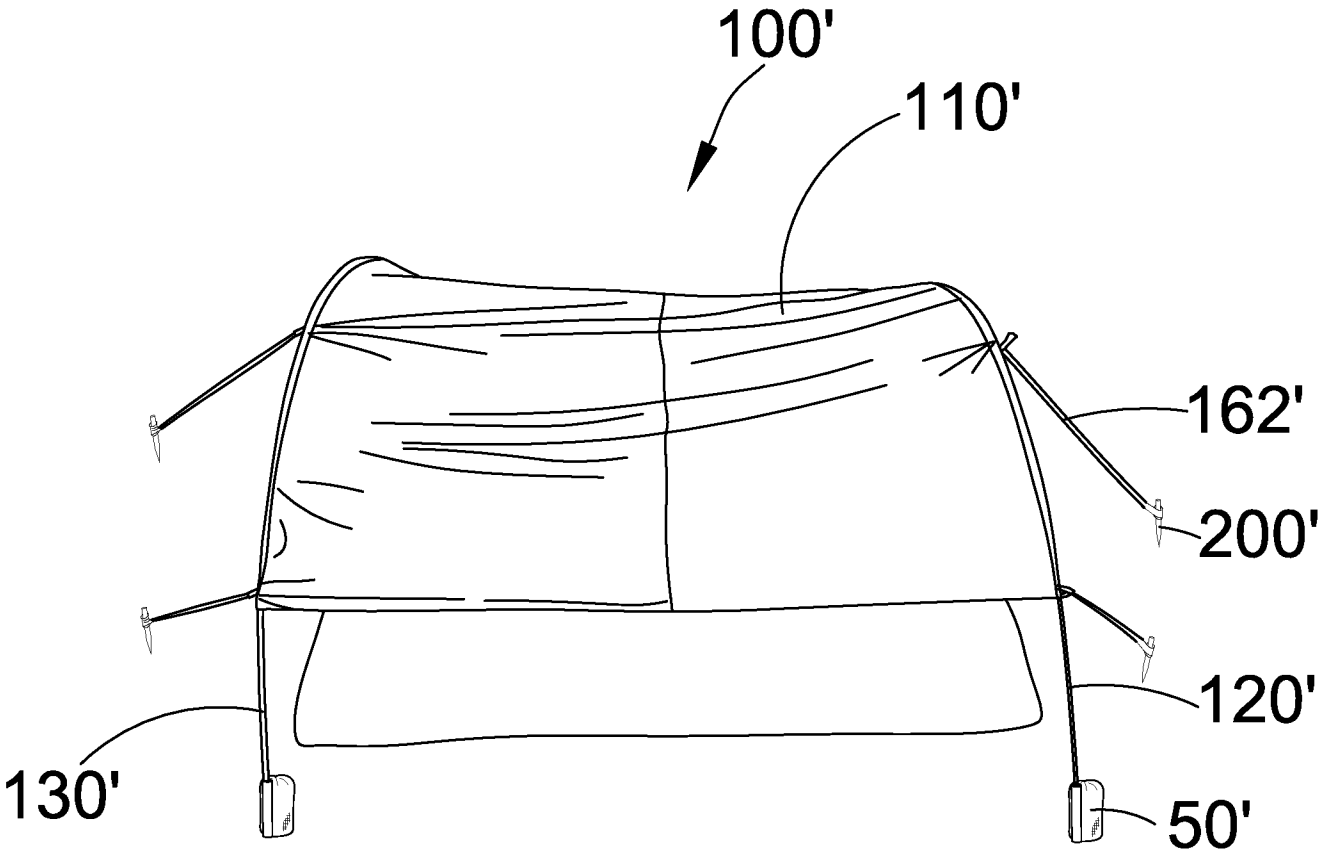
FIG. 20 is a second alternative mode of the multi-purpose shelter according to the second preferred embodiment of the present invention.
Figure 21:
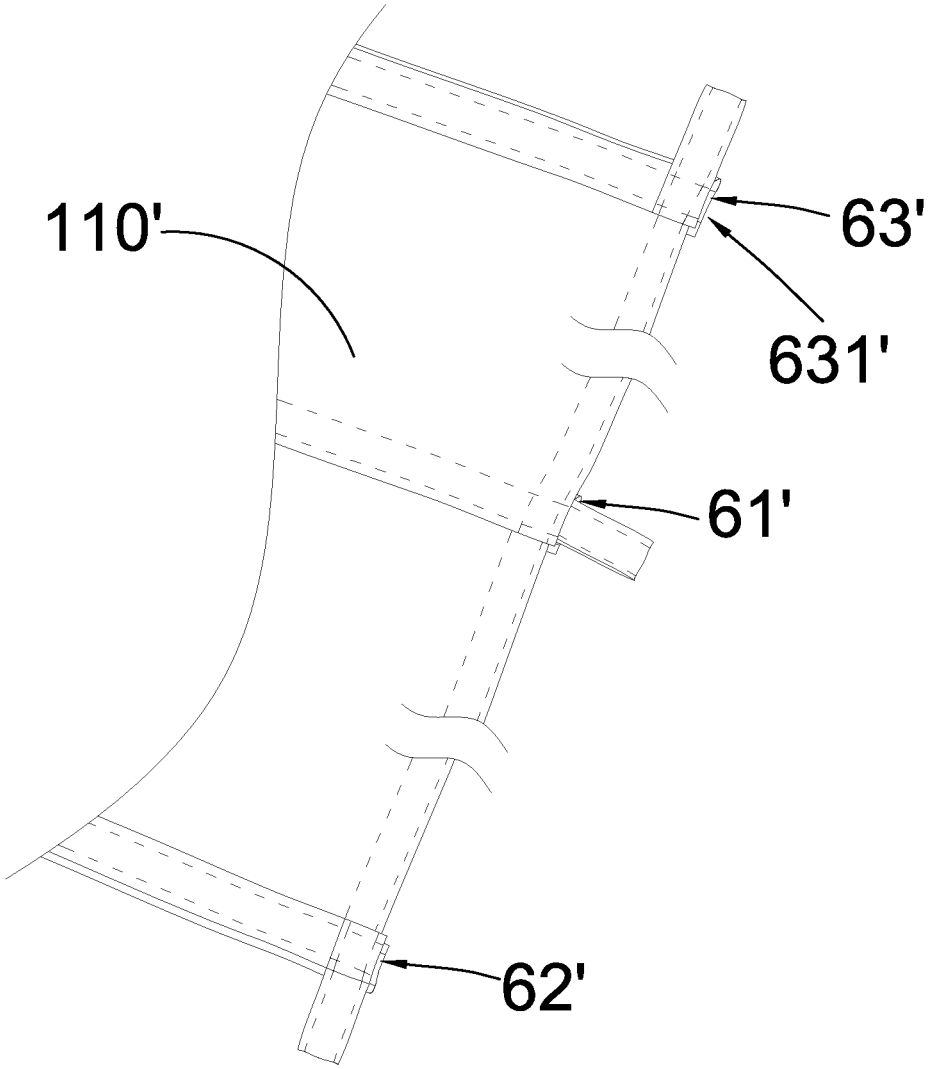
FIG. 21 is a schematic diagram of a covering fabric of the second alternative mode of the multi-purpose shelter according to the second preferred embodiment of the present invention.

Referring to FIG. 20 to FIG. 21 of the drawings, a second alternative mode of the multi-purpose shelter 100' according to the second preferred embodiment of the present invention is illustrated. The second alternative mode is another alternative configuration of the multi-purpose shelter 100'. According to the second alternative mode of the second preferred embodiment, the covering fabric 110' may further have a third pocket 63' extended along a transverse direction of the covering fabric 110' at a position space apart from the first pocket 61' and the second pocket 62'. The third pocket 63' may be structurally identical to the first pocket 61' and the second pocket 62', and may have two third pocket openings 631' formed at two ends of the third pocket 63' respectively.

The purpose of the third pocket 63' is to support the covering fabric 110' at different positions so that the multi-purpose shelter may be erected in different configuration than that of the second preferred embodiment described above. The third pocket 63' may be formed on one of the side edges 111' of the covering fabric 110' and space apart from the first rod member 120'. According to the second alternative mode of the second preferred embodiment, the second pocket 62' and the third pocket 63' may extend along two opposite side edges 111' of the covering fabric 110' respectively, while the first pocket 61' may be positioned in between the second pocket 62' and the third pocket 63'. The first pocket 61', the second pocket 62' and the third pocket 63' may be parallel with each other.

In this second alternative mode, the first rod member 120' and the second rod member 130' may be arranged to pass through the third pocket 63' and the second pocket 62' respectively, wherein each of the first rod member 120' and the second rod member 130' may be bent and folded to form a curved contour (e.g. an arc-shape contour) so as to support the covering fabric 110' to be erected on a support surface. In other words, two rod members are necessary to set up the multi-purpose shelter in this second alternative mode.

In order to set up the multi-purpose shelter in the configuration shown in FIG. 20 of the drawings, the cords 162' may connect the four corner portions 112' or other portions of the covering fabric 110' to the support surface by attaching one end of the cords 162' to one of the corner portions 112' and another end of the cords 162' to the support surface. The cords 162' must be stretched to create a predetermined of tension so as to pull the covering fabric 110' toward the support surface. The covering fabric 110' may be suspendedly supported between the first rod member 120' and the second rod member 130'.

In this second alternative mode, the multi-purpose shelter 100' may comprise four weight members 50' in which the weight members 50' may be attached on the first end segment 126' and the second end segment 127' of the first rod member 120', and the third end segment 136' and fourth end segment 137' of the second rod member 130' respectively for providing anchor to the first rod member 120' and the second rod member 130'. The structure of each of the weight members 50' has been described in the second preferred embodiment above. The third end segment 136' and the second end segment 137' may be arranged to penetrate through the securing compartments 512' of the corresponding weight containers 51' respectively.

Referring to FIG. 20 of the drawings, when the first rod member 120' and the second rod member 130' are inserted and penetrate through the first pocket 61' and the third pocket 63' respectively, a user is able to slight bent the first rod member 120' and the second rod member 130' so that they form an arc shape for supporting the covering fabric 110'. As such, the entire covering fabric 110' may be suspendedly supported above the support surface so as to maximize the size of the shelter space formed underneath the covering fabric 110'. The first through fourth end segments 126', 127', 136', 137' may be affixed or mounted or inserted into the support surface for securing the first rod member 120' and the second rod member 130'.

From the forgoing descriptions, one skilled in the art may appreciate that a user may freely utilize one or more of the first through second rod member 120', 130' and insert them through one or more first through third pocket 61', 62', 63' for creating different configurations of the multi-purpose shelter of the present invention.

The present invention, while illustrated and described in terms of a preferred embodiment and several alternatives, is not limited to the particular description contained in this specification. Additional alternative or equivalent components could also be used to practice the present invention.

What is claimed is:

1. A multi-purpose shelter, comprising:

a covering fabric having a plurality of side edges, and a first pocket extending along a transverse direction of said covering fabric along a mid-portion thereof, said covering fabric comprising a first fabric member and a second fabric member, each of said first fabric member and said second fabric member having an inner stitching rim, said inner stitching rims overlapping with each other and being stitched together by two spacedly apart stitching threads so as to form said first pocket, said covering fabric being suspendedly supported such that a highest point is an area around said first pocket, said covering fabric downwardly and inclinedly extending toward said two side edges;

a first rod member having a first forward end, a first backward end, and a first main portion extending between said first forward end and said first backward end, said first main portion passing through said first pocket of said covering fabric, and being folded to form an arc-shaped contour between said first forward end and said first backward end so as to be erected on a support surface, said first rod member further comprising a first connecting cord, a first end segment, a second end segment, and a plurality of first connecting rod segments, each of said first end segment, said second end segment, and said first connecting rod segments forming a hollow structure having a first central cavity for accommodating said first connecting cord which extends through said first end segment, said second end segment, and said plurality of first connecting rod segments, said first forward end and said first backward end being formed on said first end segment and said second end segment respectively, each of said first end segment, said second end segment and said first connecting rod segments having a first main section and a first contracted section, wherein an outer diameter of said first contracted section is smaller than that of said first main section, each of said first contracted sections being arranged to detachably insert into said first main section of one of said adjacent first end segment, said second end segment and said first connecting rod segments;

a plurality of cords each having a first end portion detachably connected to one of said side edges of said covering fabric, and a second end portion affixed on said support surface at a predetermined angle, each of said cords being stretched to establish a predetermined amount of tension for pulling said covering fabric; and at least a weight member detachably attached on one of said first forward end and said first backward end of said first rod member for providing a secure support to said multi-purpose shelter on said support surface, said covering fabric being supported by said first rod member and said and stretched by said cords to form a shelter space underneath said covering fabric; and a plurality of loop straps spacedly formed on said side edges of said covering fabric, wherein said first end portion of said each of cords is arranged to detachably fasten to one of said loop straps so as to detachably connect to said corresponding side edge of said covering fabric, wherein said covering fabric further has a second pocket extended along a transverse direction of said covering fabric at a position space apart from said first pocket, said second pocket having two second pocket openings formed at two ends thereof, and extending along one of said side edges of said covering fabric.

2. The multi-purpose shelter, as recited in claim 1, further comprising a second rod member arranged to detachably penetrate through said second pocket, said second rod member having a second forward end, a second backward end, and a second main portion extending between said second forward end and said second backward end, said second main portion passing through said second pocket of said covering fabric, and being folded to form an arc-shaped contour between said second forward end and said second backward end.

3. The multi-purpose shelter, as recited in claim 2, wherein said second rod member comprises a second connecting cord, a third end segment, a fourth end segment, and a plurality of second connecting rod segments, each of said third end segment, said fourth end segment, and said second connecting rod segments forming a hollow structure having a second central cavity for accommodating said second connecting cord which extends through said third end segment, said fourth end segment, and said plurality of second connecting rod segments, said second forward end and said second backward end being formed on said third end segment and said fourth end segment respectively.

4. The multi-purpose shelter, as recited in claim 3, wherein each of said third end segment, said fourth end segment and said second connecting rod segments has a second main section and a second contracted section, wherein an outer diameter of said second contracted section is smaller than that of said second main section, each of said second contracted sections being arranged to detachably insert into said second main section of one of said adjacent third end segment, said fourth end segment and said second connecting rod segments.

5. The multi-purpose shelter, as recited in claim 4, wherein said first rod member and said second rod member extend through said first pocket and said second pocket respectively, each of said first rod member and said second rod member being bent to form an arc shape to support said covering fabric in such a manner that said first fabric member forms a top ceiling of said shelter space, and said second fabric member downwardly and inclinedly extend from said first fabric member to shield a lower portion of said shelter space.

6. The multi-purpose shelter, as recited in claim 5, wherein said covering fabric further has a third pocket extended along a transverse direction of said covering fabric at a position space apart from said first pocket and said second pocket, said third pocket having two third pocket openings formed at two ends thereof, and extending along one of said side edges of said covering fabric which is opposite to said second pocket.

7. The multi-purpose shelter, as recited in claim 6, wherein said first rod member and said second rod member extend through said first pocket and said third pocket respectively, each of said first rod member and said second rod member being bent to form an arc shape to support said covering fabric in a suspended manner.

* * * * *